US012281473B2

(12) United States Patent
Vakaliuk et al.

(10) Patent No.: US 12,281,473 B2
(45) Date of Patent: Apr. 22, 2025

(54) SYSTEM AND METHOD FOR CONNECTING TEXTILE-REINFORCED STRUCTURAL MODULES, APPARATUS AND METHOD FOR PRODUCING A TEXTILE REINFORCEMENT OR A TEXTILE-REINFORCED STRUCTURAL MODULE, CONCRETE COMPONENT, PRINTER DESCRIPTION FILE AND YARN DEPOSITION FILE

(71) Applicant: TECHNISCHE UNIVERSITÄT DRESDEN, Dresden (DE)

(72) Inventors: Iurii Vakaliuk, Dresden (DE); Maria Patricia Garibaldi, Hohenstein-Ernstthal (DE); Steffen Rittner, Dresden (DE)

(73) Assignee: Maria Garibaldi, Hohenstein-Ernstthal (DE)

( * ) Notice: Subject to any disclaimer, the term of this patent is extended or adjusted under 35 U.S.C. 154(b) by 0 days.

(21) Appl. No.: 17/766,225

(22) PCT Filed: Oct. 2, 2020

(86) PCT No.: PCT/DE2020/100850
§ 371 (c)(1),
(2) Date: Apr. 2, 2022

(87) PCT Pub. No.: WO2021/063452
PCT Pub. Date: Apr. 8, 2021

(65) Prior Publication Data

US 2024/0052636 A1 Feb. 15, 2024

(30) Foreign Application Priority Data

Oct. 2, 2019 (DE) ..... 102019126607.6

(51) Int. Cl.
*E04C 5/16* (2006.01)
*E04C 5/07* (2006.01)

(52) U.S. Cl.
CPC ..... *E04C 5/163* (2013.01); *E04C 5/07* (2013.01)

(58) Field of Classification Search
CPC ... E04C 5/163; E04C 5/07; E04C 5/12; E04C 5/122; E04C 5/16; E04C 5/162;
(Continued)

(56) References Cited

U.S. PATENT DOCUMENTS 2,920,475 A * 1/1960 Graham ..... E04B 1/043 52/432
11,352,802 B1 * 6/2022 Rush ..... E04C 5/162
(Continued)

FOREIGN PATENT DOCUMENTS

DE 19823610 A1 12/1999
DE 202006007316 U1 9/2007
(Continued)

*Primary Examiner* — Patrick J Maestri
(74) *Attorney, Agent, or Firm* — Michael Soderman

(57) ABSTRACT

The invention relates to a system for connecting textile-reinforced structural modules along a connecting edge (76) having an edge groove (74) comprising yarn loops (4). According to the invention, the system comprises a wedge element (410) and two shell elements (420) having a keyway (422) and is provided for insertion into the two edge grooves (74) having overlapping yarn loops (4), wherein further the wedge element (410) is provided for partial extraction from the two oppositely arranged keyways (422) so that the shell elements (420) can be spread away from each other by wedge action and the yarn loops (4) can be pulled together. The invention further relates to an apparatus and a method for producing a textile reinforcement (10) comprising a yarn (2) arranged within a base frame (100) or for producing a textile-reinforced structural module (72) comprising the
(Continued)

textile reinforcement (10) and a curable material, wherein a freely formable shaping device (200) is provided on which the structural module is formed. According to the invention, the textile reinforcement (10) can be formed between yarn holding devices (130, 180) arrangeable on bendable frame strips (110). The invention also relates to a concrete component comprising connected concrete structural modules and a printer description file, and a yarn deposition file.

6 Claims, 21 Drawing Sheets

(58) Field of Classification Search
CPC ..... E04C 5/166; B28B 7/025; B28B 23/0006; E04B 1/6162
See application file for complete search history.

(56) References Cited

U.S. PATENT DOCUMENTS

| | | | | |
|---|---|---|---|---|
| 2019/0134848 | A1 | 5/2019 | Podgorski et al. | |
| 2021/0270035 | A1* | 9/2021 | Silva | E04C 5/12 |
| 2022/0120104 | A1* | 4/2022 | Ramirez | E04G 23/0244 |

FOREIGN PATENT DOCUMENTS

| | | | |
|---|---|---|---|
| DE | 102015100438 | B3 | 3/2016 |
| DE | 102016100455 | A1 | 7/2016 |
| EP | 3381637 | A1 | 10/2018 |
| EP | 3431172 | A1 | 1/2019 |
| WO | 2007074840 | A1 | 7/2007 |

* cited by examiner

SYSTEM AND METHOD FOR CONNECTING TEXTILE-REINFORCED STRUCTURAL MODULES, APPARATUS AND METHOD FOR PRODUCING A TEXTILE REINFORCEMENT OR A TEXTILE-REINFORCED STRUCTURAL MODULE, CONCRETE COMPONENT, PRINTER DESCRIPTION FILE AND YARN DEPOSITION FILE

CROSS REFERENCE TO RELATED APPLICATIONS

This application is the U.S. national stage of International Application No. PCT/DE2020/100850, filed on 2020 Oct. 2. The international application claims the priority of DE 102019126607.6 filed on 2019 Oct. 2; all applications are incorporated by reference herein in their entirety.

BACKGROUND

The invention relates to a system and method for connecting textile-reinforced structural modules along at least one connecting edge, wherein each structural module has at least one continuous edge groove comprising yarn loops at least along the connecting edge. The invention further relates to an apparatus and a method for producing a textile reinforcement comprising at least one yarn arranged within a base frame, or for producing a textile-reinforced structural module comprising the textile reinforcement and a curable material, wherein a shaping device is provided which comprises a free-forming shaping layer on the forming surface of which the reinforcement or the structural module is formed. The invention also relates to a concrete component comprising concrete structural modules connected to form the concrete component, and to a printer description file for producing a wedge element and/or a shell element as parts of the system for connecting textile-reinforced structural modules, and a yarn deposition file for carrying out a method for producing a textile reinforcement.

Devices and processes for the production of textile reinforcement are known from the prior art, as is the production of double-curved molds or free forms. DE 10 2015 100 438 B3 describes a process for the production of precast elements from textile concrete, in which a previously formed tensioned textile is arranged in a formwork as reinforcement and cast with concrete. For this purpose, the tensioned textile is first formed from a yarn free of polymeric binders by means of a laying device in a base frame, in that the yarn is laid under mechanical tension between yarn holding devices arranged on the base frame. It is not possible to produce curved or freely shaped components.

A formwork table for the production of double-curved or free-formed components from hardening materials, particularly concrete, is known from DE 198 23 610 B4. The formwork table comprises a forming face, a substructure for supporting the forming face, and adjusting devices for supporting and reversibly deforming the substructure and thus the forming face. The substructure consists of a bendable grating that can be distorted in one plane. A cover with an elastic membrane or installing a distortable sealing substance in the grid is provided for sealing. The subsequent connection of several components is provided. However, it is impossible to make a reinforcement, especially a textile reinforcement, in the formwork.

A system for connecting reinforced structural modules is known from the publication DE 20 2006 007 316 U1, in which each structural module has at least one peripheral edge groove having loops at least along the connecting edge, wherein the device has a wedge element with wedges on at least one outer surface. Shell elements having inner surfaces corresponding to the wedges are included for this purpose. The wedge element and the at least one shell element are provided for insertion into the at least two edge grooves with the overlapping loops, such that the wedges and the corresponding surfaces face each other. The wedge element is provided for partial extraction or insertion, in this case by means of wedges, relative to the at least one shell element, so that by means of wedge action between the wedges and the corresponding surfaces, the shell elements are spread away from each other, and the overlapping loops looping around the device are simultaneously drawn towards each other. However, the loops are not connected to the reinforcement; they are inserted into the less load-bearing matrix material into which the forces are transferred. The shell elements are short, rigid, and rectilinear-tubular in shape, so they do not allow the continuous connection or connection of nonlinear edge grooves. Each shell element must also be fixed separately to spread the adjacent loops and represent only one locally acting connection in each case.

SUMMARY

The invention relates to a system for connecting textile-reinforced structural modules along a connecting edge (76) having an edge groove (74) comprising yarn loops (4). According to the invention, the system comprises a wedge element (410) and two shell elements (420) having a keyway (422) and is provided for insertion into the two edge grooves (74) having overlapping yarn loops (4), wherein further the wedge element (410) is provided for partial extraction from the two oppositely arranged keyways (422) so that the shell elements (420) can be spread away from each other by wedge action and the yarn loops (4) can be pulled together. The invention further relates to an apparatus and a method for producing a textile reinforcement (10) comprising a yarn (2) arranged within a base frame (100) or for producing a textile-reinforced structural module (72) comprising the textile reinforcement (10) and a curable material, wherein a freely formable shaping device (200) is provided on which the structural module is formed. According to the invention, the textile reinforcement (10) can be formed between yarn holding devices (130, 180) arrangeable on bendable frame strips (110). The invention also relates to a concrete component comprising connected concrete structural modules and a printer description file, and a yarn deposition file.

DETAILED DESCRIPTION

It is, therefore, the task of the present invention to provide a device and a method for producing a textile reinforcement and/or a structural module in a formwork table suitable for the production of free forms and, as a further task, for flexibly and securely connecting the structural modules.

The problem is solved by a system for connecting textile-reinforced structural modules, hereinafter also referred to as edge connection, wherein the structural modules are preferably concrete structural modules, and the connection is made along at least one connecting edge. The connecting edge is one of the outer edges of the structural modules prepared and suitable for connection, mainly using emerging yarn loops forming part of the textile reinforcement and formed edge grooves. Therefore, each structural module has at least partially continuous yarn loops along the connecting edge. Continuous means that one yarn loop is formed adjacent to the other, preferably with even spacing, across the area in question. The yarn loops may originate from the reinforcement emerging from the curable material, formed by the yarn loops placed around the yarn retaining device, or yarn loops placed separately in the curable material, preferably the concrete without direct connection to the reinforcement. Furthermore, an edge groove is required along the connecting edge because the connecting elements can be arranged in a concealed manner therein, while the two edges bounding the edge groove serve as connecting edges for the positioning of the structural modules to be connected.

For insertion into the at least two edge grooves arranged opposite one another for assembly, for connection to one another, with the overlapping yarn loops emerging there as part of the textile reinforcement of the structural modules to be connected, a system for connecting textile-reinforced structural modules, hereinafter referred to as edge connection, is provided. The edge connection comprises at least one, preferably at least two, shell elements, for example, formed as flat shells, each having a keyway according to the preferred embodiment and a wedge element inserted between the shell elements. According to an advantageous embodiment, the wedge and/or the shell elements also have their internal reinforcement to increase the tensile strength and/or the compressive strength.

According to the present invention, the yarn loops are part of the textile reinforcement of the structural modules and are integrally connected to them. This means that a yarn first passes through the area of textile reinforcement inside the structural module, then emerges from the structural module in the area of the edge grooves and forms the loop.

The wedge element and the at least one shell element that form the edge connection or the central connection follow the course of the connection edge continuously over its entire length. This applies in particular even if the connection edge runs non-linearly, e.g., in curves, to which the wedge element and the at least one shell element can adapt. The wedge element and the at least one shell element enable such adaptation through the use of materials that withstand compressive loads transverse to the longitudinal axis but are nevertheless flexible or plastically formable in the longitudinal direction. The compressive load is evenly distributed along the length of the shell elements by a large number of yarn loops so that local load peaks are avoided.

Instead of shaping wedge elements and shell elements that are originally aligned in a straight line, according to an advantageous embodiment, it is also possible to produce the wedge elements and the shell elements in a generative production process, e.g., in a 3D printer, in the desired curved shape predetermined by the course of the edge grooves of the structural modules.

According to an advantageous further development, wedge elements and/or shell elements consist of a composite material, whereby a fiber reinforcement is provided. This may comprise, for example, carbon or glass fibers and epoxy resin as matrix material. Alternatively, the structure can also be made from layers of a composite material or another suitable sheet-like material. In particular, the choice of material also consistently avoids corrosion problems.

The purpose of the wedge element is that it can be inserted into the two opposing wedge grooves of the shell elements so that when the wedge element is partially pulled out, the shell elements can be spread away from each other, and the overlapping yarn loops can be pulled together. This is achieved by a preferably redundant wedge-shaped design of the contacting surfaces, with the wedging action occurring between the outer surface of the wedge element and the inner surfaces of the wedge grooves facing the wedge element in the installed state. Relative longitudinal movement of the wedge element and the shell element in the first direction of movement causes the wedges of the wedge element and the keyway, which are incorporated in the surfaces, to run up and interact. It causes the shell elements to spread away from the wedge element.

Since the yarn loops of one structural module are looped around the edge connection, which is arranged on the side of the edge connection facing away from this structural module, this structural module is pulled towards the edge connection. The second structural module is pulled in accordingly so that both structural modules are pulled together and thus ultimately firmly connected by the connection edges being pulled firmly against each other.

The yarn loops overlap in different ways depending on the embodiment of the device for connecting textile-reinforced structural modules. According to a first embodiment, the yarn loops of both structural modules to be connected have the same orientation and interlock before the device for connecting textile-reinforced structural modules is inserted into the yarn loops.

According to an advantageous embodiment, the shell element and wedge elements are flexible and follow the curvature of the edges of the structural modules. This also allows the free-form structural modules of the invention to be connected together to form a component. The freeform or freeform surface includes a single curvature, a double curvature, a ruled surface composed of straight lines in a specific manner, a surface of revolution, a translational surface, a non-uniform rational B-spline (NURBS, a mathematically defined curve or surface for arbitrary modeling shapes), and geometrically undefined surfaces.

More than two structural modules can be connected according to an alternative embodiment of shell elements and wedge elements. According to the solution provided for this purpose, they must be inserted into the yarn loops of each of the structural modules to be connected.

According to a preferred embodiment, the interlocking yarn loops are aligned such that the yarn loops form a joint opening for the insertion of the edge connection; in particular, according to the preferred embodiment, the yarn loops are aligned perpendicular to the longitudinal direction of the edge groove, wherein alternative angular positions are also provided. Alternatively, the yarn loops are aligned in the plane of a connecting edge and are bound into a loop bed by one connecting edge each, wherein the loop bed is also spread during assembly utilizing shell elements and wedge elements, but in a modified form. The advantage of using loop beds is that the time-consuming insertion of shell elements and wedge elements into the overlapping yarn loops is unnecessary.

A solution in which the contact surfaces between the shell element and the wedge element have an interposed rolling track helps reduce frictional losses and increase the spreading force.

It has also proved advantageous if an assembly aid is provided, which engages in the edge grooves of the structural modules to be connected and holds them in the required position for assembly. It is particularly advantageous if shell elements and wedge elements can be guided inside the assembly aid so that the assembly aid remains in the connected structural modules. This facilitates the structural modules' positioning and subsequent connection and simplifies assembly.

The problem is further solved by an apparatus for producing a textile reinforcement comprising at least one yarn arranged within a base frame, or for producing a textile-reinforced structural module comprising the textile reinforcement and a curable material, in particular concrete. The textile reinforcement may be in the form of a mesh. In the latter alternative, the apparatus also serves as a formwork.

The structural module is an independently produced module intended as a component of a higher-level, larger structure, a component, and which is assembled with other structural modules to form the component. A curable material is any material that can be fluidly introduced into a mold and cured there to form a solid structural module. In the context of the present invention, concrete, in particular, is provided as such a curable material.

Furthermore, a shaping device, preferably free-formable using a control device and comprises a shaping layer, is provided as an essential component. The reinforcement or structural module is formed on the forming plane, on the upper side of the shaping layer.

The preferred control equipment also includes drive elements, such as motors, and force transmission elements that transmit the force of the drive elements, e.g., utilizing traction cables, up to the shaping layer. For alternative shaping layers, the control devices also include equipment for surface processing, such as milling cutters or additive or generative production.

Alternatively, non-controllable, non-flexible shaping devices are provided, the shaping layer of which is brought into the desired shape, for example, in two planes and thus into a free form, by other means, for example, by machining a shaping block, for example, formed as a wax block, steel, wood or foam block, the surface of a sand mold or by a method of additive or generative production, and can accommodate the reinforcement and the curable material on the upper side, of the forming surface.

According to the invention, yarn holding devices are provided, between which the textile reinforcement can be formed by guiding the yarn from a first yarn holding device to a second yarn holding device and so on and depositing it on the forming plane. Furthermore, bendable frame strips are provided to arrange the yarn holding devices. The frame strips are bendable in order to be able to adapt to the topography of the shaping layer, even if it has been formed into a free-form shape, for example. A compensation layer can also be used to achieve even better compensation or adaptation between the shaping layer and the frame strips.

The frame strips can be arranged to the base frame to create different geometric shapes such as rectangles, triangles, or polygons with varying dimensions and angles. Open shapes can also be created. The base frame forms the framework for depositing the yarn as textile reinforcement, and the yarn is stretched between the frame strips. The ends of the frame strip can overlap; the overlapping ends of the frame strip form the corners of the base frame.

Advantageously, the shaping layer comprises a free-forming core layer formed from core elements. The core elements are movably connected to each other using connectors and form a kind of mat or grid.

The core layer has an outer sealing layer on a shaping layer, an upper side of the forming layer on which the reinforcement or the structural module is formed, and an inner sealing layer on the plane opposite the forming plane. The inner sealing layer enables fluid pressure to be built up in a pressure vessel, the forming layer's top side. Controllable actuators, such as control cables, can act against the fluid pressure and are connected at articulation points to the forming layer or directly to the core layer. They are driven, for example, by controllable motors. Other types of actuators can be pneumatic actuators or mechanical linear actuators.

In addition, the space between the outer sealing layer and the inner sealing layer forms a fluid-tight area, allowing other fluids to be introduced there under pressure and, above all, stabilizing the outer sealing layer. The individual core elements are connected to each other via overflow openings arranged in the area of the connectors.

According to alternative embodiments, the free-form shaping layer is designed as a free-form surface, or free-form surface made, for example, from a mold block, in particular a wax block, steel, wood, or foam block, in a sand mold or from a surface produced using additive or generative production from the materials available for this purpose. These surfaces can be designed as required but cannot be changed flexibly, as is the case with the previously described shaping layer with its core layer.

Preferably, the yarn holding devices are designed as horizontal yarn holding devices, comprising a base body and two horizontally arranged yarn holding rollers, around which the yarn can be placed in a yarn loop. Alternatively, the yarn holding devices are designed as vertical yarn holding devices with two vertically arranged yarn holding rollers. The yarn holding rollers are arranged one behind the other in the direction of the yarn. This allows a yarn loop of the required length to be formed, particularly for forming an edge connection of the structural modules connect them.

It has proven advantageous to provide a yarn gate or yarn guide through which the yarn exits the horizontal yarn holding device or the vertical yarn holding device. This also allows the yarn to protrude from the yarn holding device at a certain angle without fear of slipping off the yarn from the holding rollers. In particular, the yarn guide offers a high degree of flexibility in this regard. For example, the yarn guide allows the two ends of the yarn loop to exit at a greater distance from each other, which advantageously already corresponds to an intended grid dimension of the reinforcement.

The resulting yarn loop in the vertical yarn holding device with yarn holding rollers arranged in the vertical axis of rotation has a twisted position compared to the position resulting from the horizontal yarn holding device.

An embodiment of the horizontal yarn holding device or the vertical yarn holding device in which the base body has an electrically operable holding magnet has proved advantageous. This enables the horizontal yarn holding device or the vertical yarn holding device to be temporarily attached to a magnetic substrate in a controllable manner. At first, consider the frame strip as substrate.

Further development of this solution offers particular advantages, in which the frame strips have longitudinally running electrically contactable conductive tracks, which are arranged on the surface facing the yarn holding device. The conductive track can be connected to a current source, which is preferably done at one end of the conductive tracks or the frame strips. The conductive tracks may supply electrical power to the holding magnet so that the holding magnet holds the yarn holding device on the frame strip as long as the conductive tracks supply power, and the horizontal yarn holding device or the vertical yarn holding device can be easily disassembled after the power supply is interrupted. The holding magnet can be designed as a solenoid.

An advantageous embodiment of the present invention provides a yarn deposit device suitable for placing the yarn over the yarn holding devices according to a predetermined pattern, forming the yarn loops there and producing the reinforcement in this way. In connection with appropriate control of the yarn deposit device, the production of the reinforcement can be automated.

According to a further development of the previously described embodiment, the yarn depositing device comprises an impregnating yarn device that can provide the yarn with a curable, flowable impregnating agent immediately before depositing. Alternatively, different methods and materials are provided for fixing the yarns after deposition. According to one method, the yarn used is a hybrid fiber to which thermoplastic fibers, and thus fibers that can be thermally activated for bonding, have been added during production. During thermal activation after yarn deposition, the thermoplastic fibers melt and bond together the fibers suitable for load transfer, e.g., carbon fibers. In this case, the thermally activable material is cured as soon as the thermoplastic fibers have cooled down and returned to their solid aggregate state.

According to another method for fixing, the yarn is impregnated with a curable fiber matrix material with which the yarn is stabilized. This can be done immediately after the yarn is produced, wherein the yarn is used pre-impregnated and must be protected from undesirable premature curing prior to use. Alternatively, the impregnation may be performed immediately prior to deposition, as described above. Preferably, reactive resins, such as epoxy resin, or aqueous dispersions, e.g., based on acrylate or styrene-butadiene, can be considered as curable material. Depending on the material, curing can be carried out by temperature radiation, UV radiation, radiation from an LED lamp, microwave radiation, or the like.

It is also envisaged to use a curable fiber matrix material comprising electrically conductive materials (for example, carbon platelets or nanotubes) or an electrically conductive coating for the yarn.

This makes it possible to produce reinforcement that can be removed from the shaping device in a fixed form and fed for further use even without subsequent concreting.

A further embodiment of the yarn deposit device has a cover film application device that can provide the yarn after deposit at least partially, at least over part of its length, with a protective cover layer. The covering layer forms a kind of tunnel in which the yarn is protected from undesired lateral displacement and remains displaceable in the longitudinal direction to such an extent that length adjustment can still occur. The cover layer is applied, for example, as a self-adhesive film or utilizing sealing rollers acting on the edges of the cover layer.

Another aspect of the present invention relates to a method for producing a textile reinforcement comprising a yarn or a textile-reinforced structural module comprising the textile reinforcement and a curable material, in particular concrete. A shaping layer is provided, which is curved using a control device when required at least twice, i.e., in two planes, or moreover, forms a free-form surface as defined above.

According to the invention, the textile reinforcement is formed between yarn holding devices, and further, the yarn holding devices are arranged on bendable frame strips in any arrangement, preferably by automated removal from a magazine and deposit. The frame strips are, in turn, arranged in any geometric figure to form the base frame.

The automated arrangement of the yarn holding devices on the flexible frame strips is facilitated by equipping the yarn holding devices with an electrically operable holding magnet. This goes into operation as soon as the yarn holding device with its base body and the electrical contacts arranged on its underside is placed on the cable tracks arranged on the frame strip and connected to an electrical power source, and the electrical contact is thus established. To facilitate disassembly, the power supply is interrupted.

Preferably, the yarn is laid during the formation of the textile reinforcement so that the yarn loops protrude outward, beyond the curable material or the area to be concreted. Advantageously, however, the yarn loops lie in the edge grooves of the structural module. In any case, it has proved advantageous if the yarn is deposited on a device as described above.

The problem of the present invention is also solved by a method for connecting textile-reinforced structural modules along at least one connecting edge, wherein each structural module has at least one edge groove which at least partially encircles along the connecting edge and has yarn loops. According to the invention, an edge connection is introduced into both connection edges, which are already arranged opposite one another in the assembly position, and the yarn loops of, which interlock.

In this case, the edge connection comprises a respective shell element having a keyway, wherein a wedge element is inserted between the keyways. The wedge element is then displaced relative to the two wedge grooves, or shell elements arranged opposite one another, in practical application preferably pulled out, until the shell elements with the overlapping yarn loops are spread away from one another by wedge action and the structural modules, in particular the connecting edges, are simultaneously pulled together.

The use of a fixing agent secures the connection created in this way against the undesired loosening of the wedging, for example, as a result of vibrations. Even if the wedge element is not fully extended, the fixing agent prevents the wedge element from springing back. The fixing agent may be a curable material pressed into the spaces between the wedge and shell elements, particularly between the keyways and the wedge elements, ensuring a permanent, non-detachable connection. The curable material can be concrete and epoxy resin, which acts less aggressively than concrete on shell and wedge elements.

Alternatively, a releasable fixing agent may be considered. This is designed, for example, as a mechanical securing means, in particular, a screwable bolt, which secures the wedge element relative to one or both shell elements or the structural element. Another embodiment of a releasable fixing agent provides a non-curable material or a curable material with defined compressive strength, which prevents loosening of the connection in the event of vibration, but whose compressive strength can be overcome by a corresponding pull-out force applied to the wedge element.

Another aspect of the present invention relates to a concrete building component comprising concrete structural modules produced by a method and variants thereof as previously described. These are connected to form the concrete building component by a method as also previously described. It is further envisaged that the concrete component may comprise different types of textile reinforcement. This includes a tubular reinforcement element formed in a grit shape using the at least one continuously arranged intersecting yarn. In this regard, the intersecting portions of the at least one yarn are interconnected such that the interconnection has a shear elasticity such that the reinforcement element is equipped for intended extensibility in the direction of a longitudinal axis of the reinforcement element and the resulting deformation in the transverse direction. Another type of reinforcement, a textile transverse force reinforcement according to structural shape types, is particularly suitable for connecting two sandwiched shells of a concrete component.

Another aspect of the present invention relates to a printer description file. The printer description file is used for generatively producing the wedge element and/or the shell element as parts of the system for connecting textile-reinforced structural modules along at least one connecting edge. The production is carried out in a generative process, e.g. in a 3D printer, or in a computer connected to a 3D printer. In this context, in the case where the wedge element and/or the shell element is designed as a composite material with its textile reinforcement, in addition to the application of matrix material in the 3D printer, the deposition of the textile reinforcement is also included, e.g., by inserting rovings. The generation in a 3D printer also enables the production of free shapes according to the course of the edge grooves of the structural modules to be connected.

Another aspect of the present invention relates to a yarn deposition file for executing a method for producing a textile reinforcement when the yarn deposition file is executed on a yarn deposit device or in the computer connected to a computer-controlled yarn deposit device. The yarn deposition file comprises a procedure or algorithm for automatic yarn deposit.

A particular advantage of the present invention, especially the possibilities for connecting the concrete structure modules utilizing the edge connection, is that the connection can be made separable. This opens up entirely new possibilities in the construction industry. Until now, deconstruction of buildings, especially those made of concrete, has always been accompanied by irreversible destruction, producing, at best, recycled material suitable for low-grade uses. With the present invention, buildings can be repaired or modified and wholly or partially dismantled and rebuilt elsewhere. Thus, the concrete structural modules are not available for recycling, if not for disposal as waste, but for complete reuse. The energy used to produce the concrete is not lost, which helps the construction industry significantly improve energy efficiency and save $CO_2$ emissions.

BRIEF DESCRIPTION OF THE DRAWINGS

Based on the description of embodiments and their illustration in the accompanying drawings, the invention is explained in more detail below. It is shown.

DETAILED DESCRIPTION OF THE PREFERRED EMBODIMENTS

Figure 1:
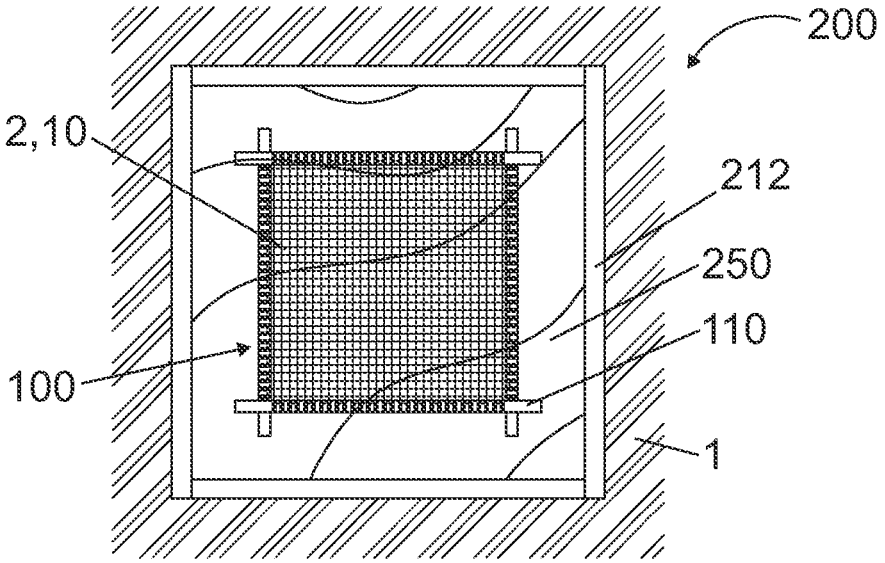
FIG. 1: A schematic top view of an embodiment of a shaping device according to the invention with reinforcement formed between a base frame.

FIG. 1 shows a schematic top view of an embodiment of a shaping device 200 according to the invention with reinforcement ten formed within a base frame 100. The shaping device 200 stands on a base 1 and is bounded by side walls 212. A shaping layer 250 is visible on the top surface, which can be shaped according to the requirements for the topography of reinforcement or structural module 72 (see, for example, FIGS. 44, 52, and 57) and can also be curved in two directions.

The base frame 100 is arranged on the shaping layer 250, created by frame strips 110 that overlap at the ends and form the corners of the base frame 100. Attached to the frame strips 110 are the yarn holding devices, described in detail later, between which yarn 2 is laid and by which it is held.

Figure 2:
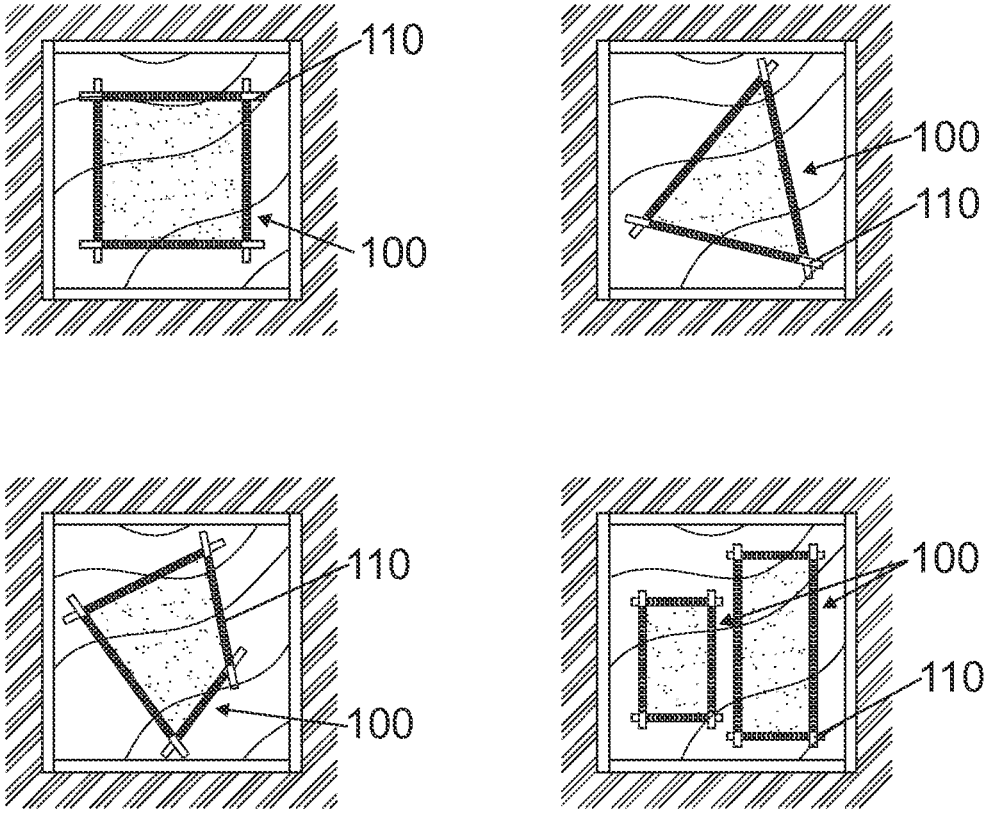
FIG. 2: Schematic top views of four different base frames in different geometric shapes.

FIG. 2 shows schematic top views of four different base frames 100 in different geometric shapes, a square, a triangle, an irregular quadrilateral and two rectangles. The examples illustrate that an almost unlimited variety of shapes, open as well as closed shapes, can be represented for the base frame. Not shown, but also provided, is the use of frame strips 110, which can also be bent in the plane or already preformed to a certain radius.

Figure 3:
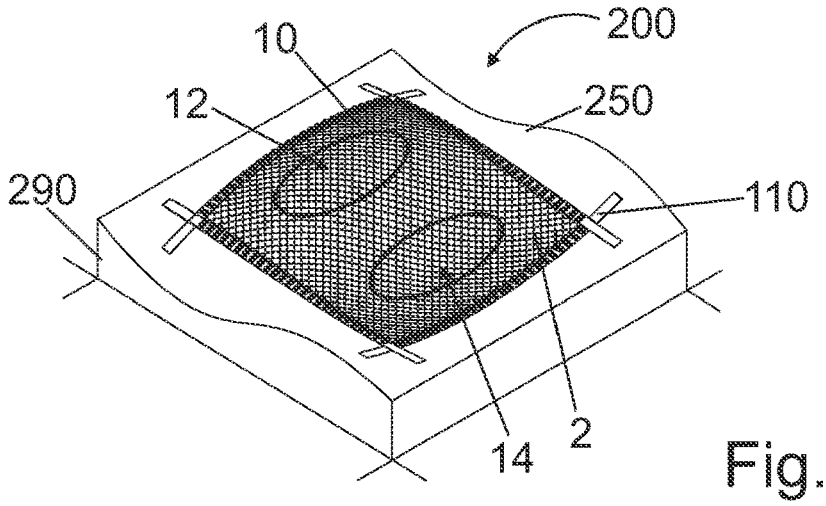
FIG. 3: A schematic perspective view of an embodiment of reinforcement according to the invention as a free-form surface.

FIG. 3 shows a schematic perspective view of an embodiment of a reinforcement 10 according to the invention as a free-form surface, wherein not only the reinforcement 10 but also the frame strips 110 adopt convex regions 12 and concave regions 14 of the surface likewise.

Figure 29:
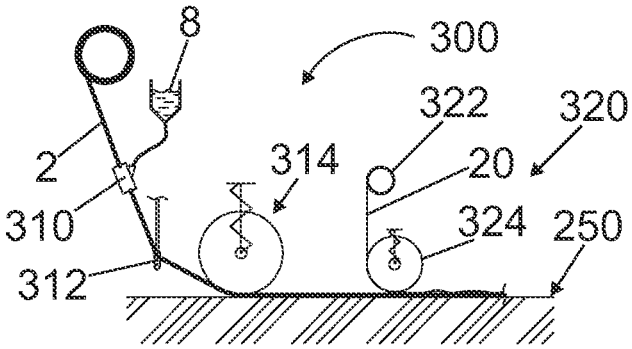
FIG. 29: A schematic representation of an embodiment of a yarn deposit device with inserted yarn pressure roller and cover film application device.
Figure 30:
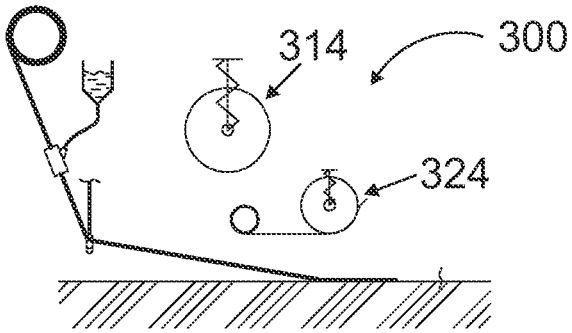
FIG. 30: A schematic representation of an embodiment of a yarn deposit device.

The embodiment of a shaping device 200 also shown is a solid shaping block for shaping, in the example, a wax block 290, the surface of which is formed as a shaping layer 250 following the requirements. In order to ensure that reinforcement ten also forms concave regions, the tension of yarn 2 must be selected to be correspondingly low when it is laid down. Alternatively, auxiliary means such as a cover film 20 can be used, compared with the description of the yarn deposit device 300 (FIGS. 29 and 30 and associated description).

Figure 4:
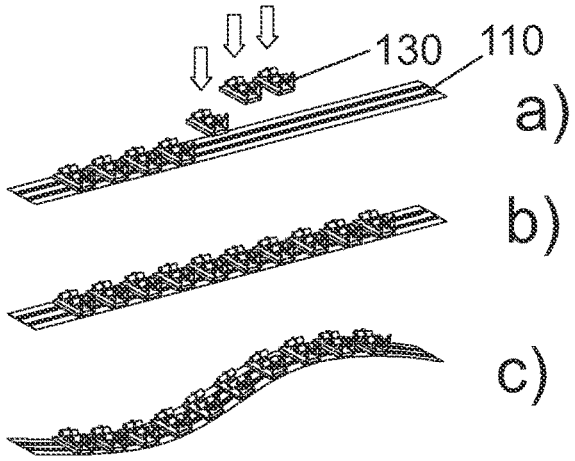
FIG. 4: A schematic perspective view of an embodiment of a frame strip and its application in connection with horizontal yarn holding devices.

FIG. 4 shows a schematic perspective view of an embodiment of a frame strip 110 and its use in conjunction with horizontal yarn holding devices 130. In view a), the horizontal yarn holding devices 130 are placed on the frame strip 110 at the desired distance and in the desired arrangement. The result is the arrangement shown in view b). View c) shows how the frame strip 110, when placed on a curved surface and convex and concave regions, takes the shape of this surface. Vertical holding devices 180 not shown here (cf. FIGS. 20, 21) can also be placed similarly.

Figure 5:
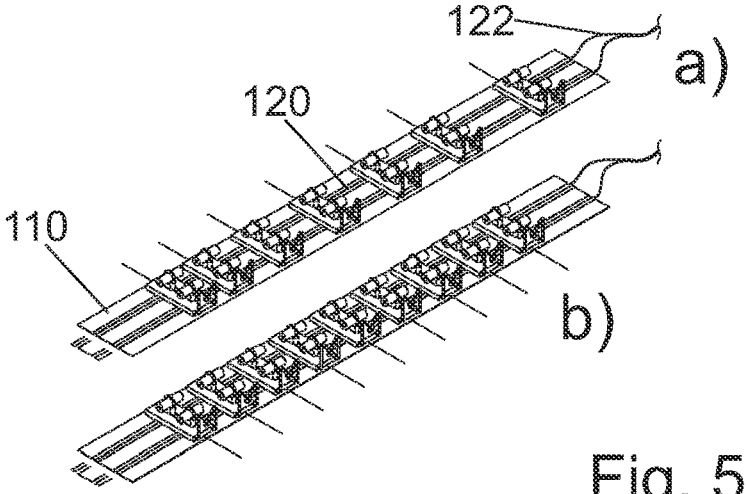
FIG. 5: A schematic perspective view of two embodiments of a frame strip with line tracks and attached horizontal yarn holding devices.

FIG. 5 shows a schematic view of two embodiments of a frame strip 110 with conductive paths 120 and attached horizontal yarn holding devices 130. View a) shows the horizontal yarn holding devices 130 attached at different distances to the frame strip 110, whereby the conductive paths 120 and a connection line 122 for the electrical energy supply are also shown. View b), on the other hand, shows the horizontal yarn holding devices 130 spaced evenly apart from one another.

Figure 17:
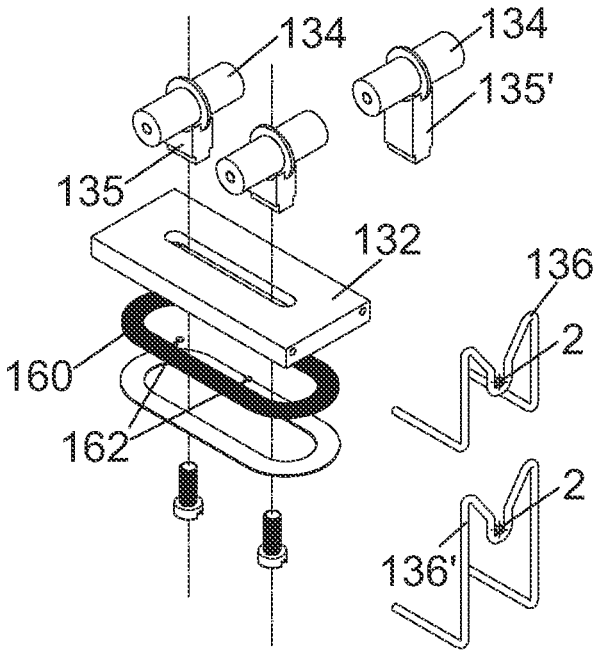
FIG. 17: A schematic perspective exploded view of an embodiment of a horizontal yarn holding device with yarn gate and holding magnets.

The electrical energy supplied to the conductive paths 120 via the connection line 122 enables the horizontal yarn holding device 130 to adhere to the frame strip 110 by magnetic force (compare FIG. 17 and associated description).

Figure 6:
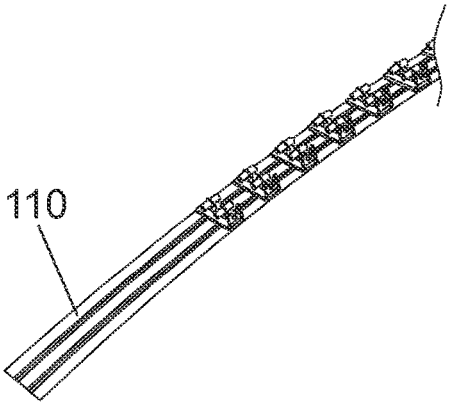
FIG. 6: A schematic perspective view of two embodiments of a frame strip with and without a single-center foot.
Figure 6:
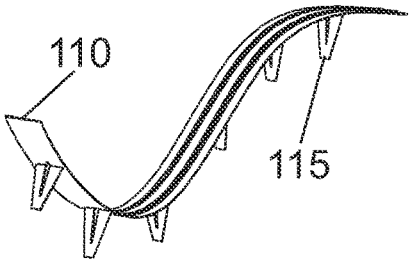

FIG. 6 shows a schematic perspective view of two embodiments of a frame strip 110 with and without a monopod foot 115. The monopod foot 115 is suitable for fixing the frame strip 110 in a relatively solid material, such as in a block of wax (compare FIG. 3 and associated description) or sand, by pressing the monopod feet 115 into the wax or sand.

Figure 7:
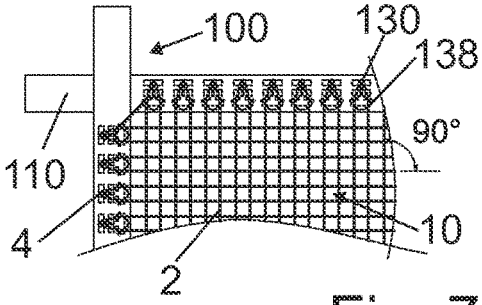
FIG. 7: A schematic top view of an embodiment of reinforcement according to the invention formed within a base frame using horizontal yarn holding devices with yarn guide.

FIG. 7 shows a schematic top view of an embodiment of a reinforcement 10 according to the invention, formed within a base frame 100 formed by frame strips 110 using horizontal yarn holding devices 130 with yarn steering 138. The horizontal yarn holding device 130 results in a position of the yarn loop 4 with a horizontal axis. Nevertheless, yarn loop 4 can still be moved to another position after curing. The same application is shown in FIGS. 8, 9, 10, and 11.

The yarn guide allows yarn 2 running into and out of a yarn loop 4 to be spread in a predetermined grid. The grid dimension corresponds to the diameter of a steering cylinder 140 (compare FIG. 12 and associated description) and the distance between the horizontal yarn holding devices 130.

Figure 8:
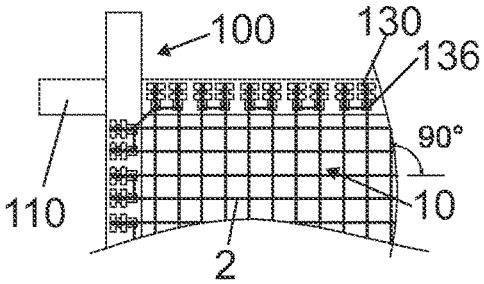
FIG. 8: A schematic top view of an embodiment of reinforcement according to the invention formed within a base frame using horizontal yarn holding devices with yarn gate.

FIG. 8 shows a schematic top view of an embodiment of a reinforcement 10 according to the invention, formed within a base frame 100 using horizontal yarn holding devices 130 with yarn gate 136. The grid dimension of reinforcement 10 is determined exclusively by the distances between the horizontal yarn holding devices 130. In the illustration (also in FIG. 7), the yarn 2 runs longitudinally from the horizontal yarn holding devices 130, which corresponds to a right angle to the frame strip 110.

Figure 9:
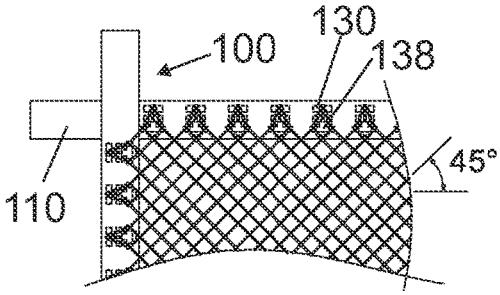
FIG. 9: A schematic top view of an embodiment of reinforcement according to the invention formed within a base frame using horizontal yarn holding devices with yarn guide.
Figure 10:
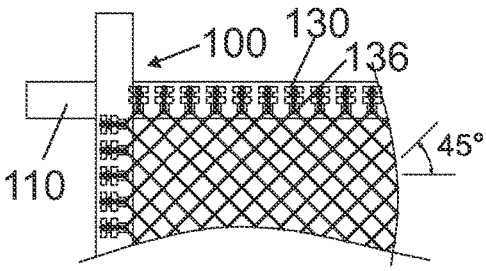
FIG. 10: A schematic top view of an embodiment of reinforcement according to the invention formed within a base frame using horizontal yarn holding devices with yarn gate.

FIGS. 9 and 10 each show a schematic plan view of an embodiment of a reinforcement 10 according to the invention, formed within a base frame 100 using horizontal yarn holding devices 130, once with yarn guiding 138 in FIG. 9 and once with yarn gate 136 in FIG. 10. In contrast to FIGS. 7 and 8, the yarn 2 runs at an angle of 45° from the horizontal yarn holding devices 130 or the frame strip 110.

Figure 11:
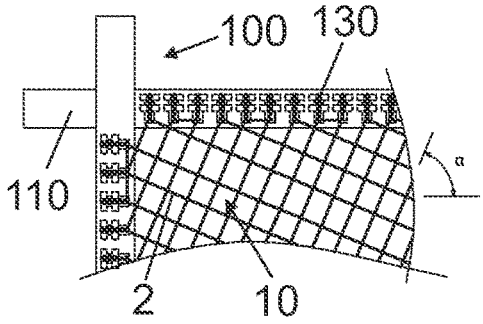
FIG. 11: A schematic top view of an embodiment of reinforcement according to the invention formed within a base frame using horizontal yarn holding devices with yarn gate.

FIG. 11 shows a schematic top view of an embodiment of a reinforcement 10 according to the invention, formed within a base frame 100 using horizontal yarn holding devices 130 with yarn gate 136. Herein yarn 2 of the reinforcement 10 is oriented at an angle other than 90° or 45°.

A vertical yarn holding device 180 (cf. FIGS. 20, 21) can also be used instead of the horizontal yarn holding device 130. The same applies to the embodiments shown in FIGS. 7 to 10.

Figure 12:
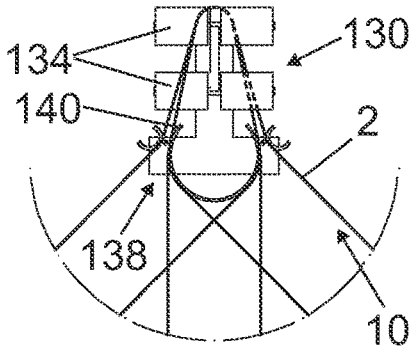
FIG. 12: A schematic detailed view of an embodiment of reinforcement according to the invention formed within a base frame using a horizontal yarn holding device with yarn guide.

FIG. 12 shows a schematic detailed view of an embodiment of a horizontal yarn holding device 130 with yarn guide 138 and yarn holding rollers 134. An essential element of the yarn guide 138 is the steering cylinder 140, the diameter D of which defines the distance between the incoming and the outgoing yarn 2 and thus ensures the grid dimension of the resulting structure of the reinforcement 10, at least in this area.

Figure 13:
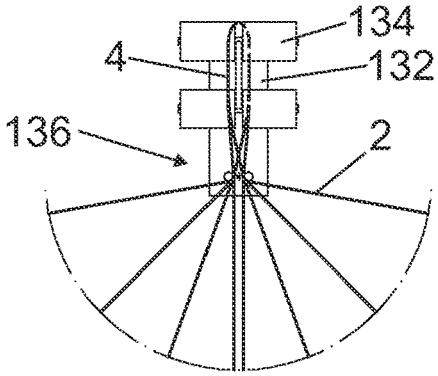
FIG. 13: A schematic detailed view of an embodiment of reinforcement according to the invention formed within a base frame using a horizontal yarn holding device with yarn gate.

FIG. 13 shows a schematic detailed view of an embodiment of a horizontal yarn holding device 130 with a base body 132 and the yarn gate 136. Several yarns 2 run in and out through the yarn gate 136 after a yarn loop 4 has been formed in each case via yarn holding rollers 134. The yarns 2 can run out of the yarn gate 136 at any angle.

The surface of the yarn gate 136 is designed to exert as little force as possible on the yarn 2, in particular by friction, utilizing a correspondingly low-friction design of the surface. Preferably, the yarn gate is made of metal, composite material, or another suitable material that is present as a thick rod and is formed into a suitable shape to grip the yarn 2 and hold it in the intended position. This applies according to the yarn guide 138 and the design of the surfaces that contact the yarn 2.

Figure 14:
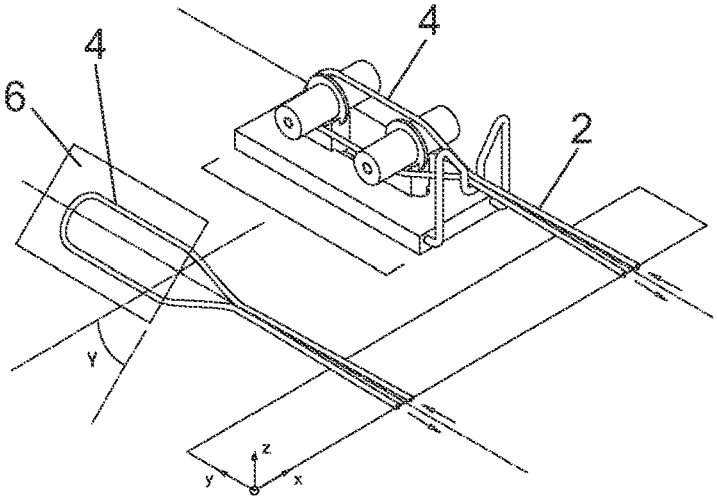
FIG. 14: A schematic perspective view of an embodiment of a horizontal yarn holding device with yarn gate and inserted yarn loop.

FIG. 14 shows a schematic perspective view of an embodiment of a horizontal yarn holding device with yarn gate 136 and inserted yarn loop 4 (embodiment on the right side) and a yarn loop 4 without horizontal yarn holding device 136. Yarn 2 can be either simple, as shown, or a roving, a plied yarn, or a plied roving. This applies to all embodiments in which a simple yarn is shown.

The difference between the two illustrations illustrates the effect of the horizontal yarn holding device 136, which specifies a particular position of the yarn loop 4, its orientation plane 6. Without the horizontal yarn holding device 136, the yarn loop 4 assumes an undefined position tilts into an arbitrary orientation plane 6, whereas when the horizontal yarn holding device 136 is used, this takes place a substantially vertical orientation, alternatively at a certain angle, deviating from the vertical. The angle of the orientation plane 6 is essential for the subsequent use of the reinforcement, at the outer edge of which the yarn loops 4 emerge and are available for use, particularly for connecting structural modules. Compare in particular FIGS. 32 to 53 and 57 and the associated description.

Figure 15:
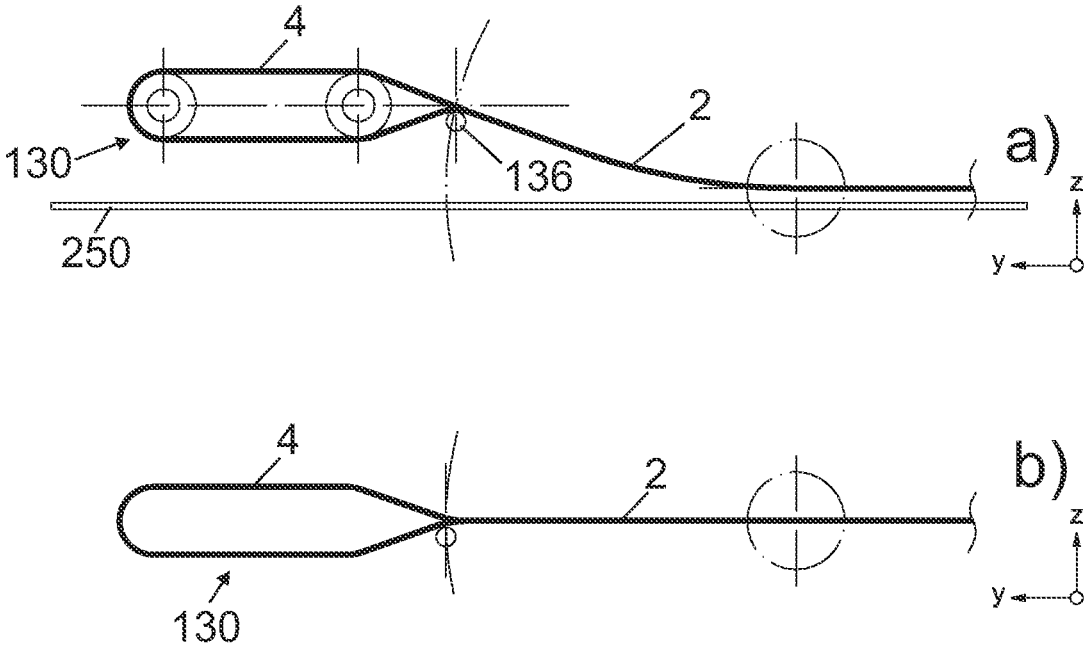
FIG. 15: A schematic side view of a horizontal yarn holding device with yarn gate and yarn loop inserted in two different variants.

FIG. 15 shows a schematic side view of a horizontal yarn holding device 130 with yarn gate 136 and yarn loops 4 inserted in two different variants and formed from the yarn 2. The yarn 2 is preferably deposited automatically, whereby the yarn tension is also set according to the individual requirement. View a) shows yarn 2 before demoulding so that it lies on the shaping layer 250 (compare, among others, FIG. 23), view b) after deshaping and with high tension.

Figure 16:
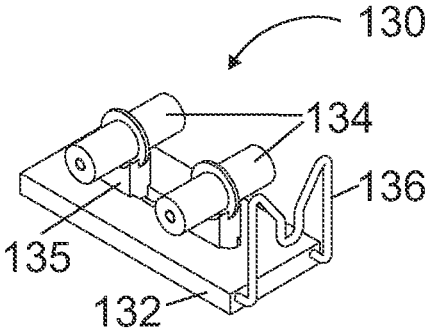
FIG. 16: A schematic perspective view of an embodiment of a horizontal yarn holding device with yarn gate.

FIG. 16 shows a schematic perspective view of an embodiment of a horizontal yarn holding device 130 with yarn gate 136. A base body 132 accommodates the two yarn holding rollers 134. For this purpose, they are each arranged on a support stand 135, which is inserted into a groove in the base body 132.

FIG. 17 shows a schematic perspective exploded view of an embodiment of a horizontal yarn holding device 130 with yarn gate 136, as already described in FIG. 16. Furthermore, the holding magnet 160 can be seen, which is arranged on the underside of the base body 132 and screwed there. The holding magnet 160, for example, formed as a solenoid or preferably as a flat coil, has contacts 162, the distance between which corresponds to that of the conductive paths 120 on the frame strip 110 (compare FIG. 5 and associated description). With the help of contacts 162, the holding magnet 160 can be supplied with electrical power as soon as the horizontal yarn holding device 130 is placed on frame strip 110. The same applies to other yarn holding devices as soon as a corresponding base body 132 is equipped with the holding magnet 160 and the contacts 162 (also compare FIG. 21 and associated description).

It can further be seen that not only the guidance of yarn 2, of which only a cross-section is shown, can be controlled in the plane, but also the vertical position can be predetermined. For this purpose, both the yarn holding rollers 134 and the yarn gate 136' are attached to the base body 132 in an elevated position in an alternative embodiment. In order to attach the yarn holding rollers 134 in an elevated position, an elevated support stand 135' is provided.

FIG. 17 illustrates the modular nature of the horizontal yarn holding device 130, as the elements are interchangeable.

Figure 18:
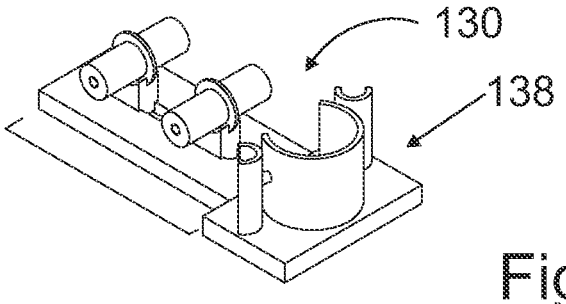
FIG. 18: A schematic perspective view of an embodiment of a horizontal yarn holding device with yarn steering.

FIG. 18 shows a schematic perspective view of an embodiment of a horizontal yarn holding device 130 with yarn guide 138. For the rest, reference is made to the explanations in FIG. 12

Figure 19:
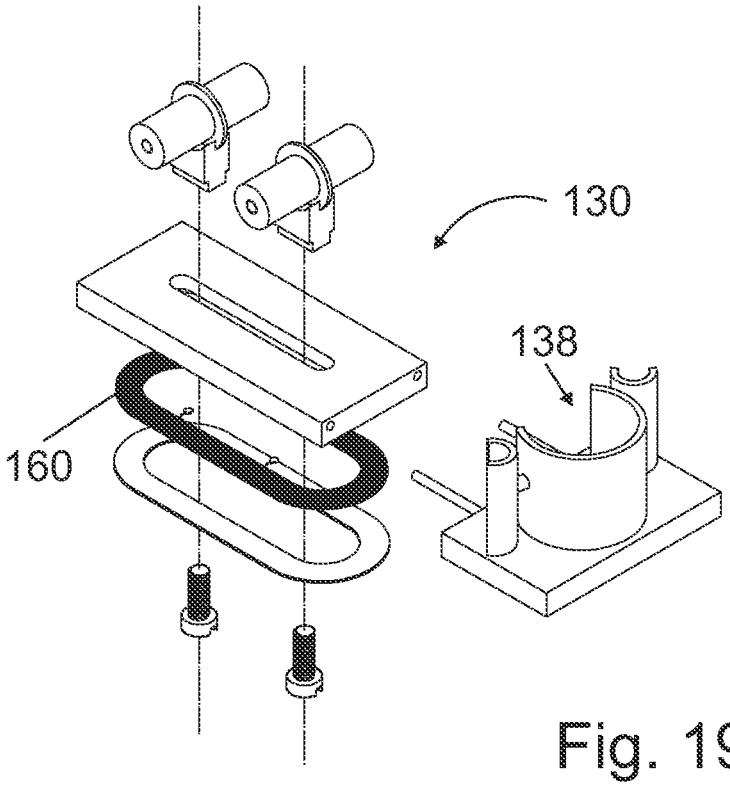
FIG. 19: A schematic perspective exploded view of an embodiment of a horizontal yarn holding device with yarn gate and holding magnets.

FIG. 19 shows a schematic perspective exploded view of an embodiment of a horizontal yarn holding device 130 with yarn guide 138 and holding magnets 160. Reference is made to the explanations of FIGS. 12 and 17.

Figure 20:
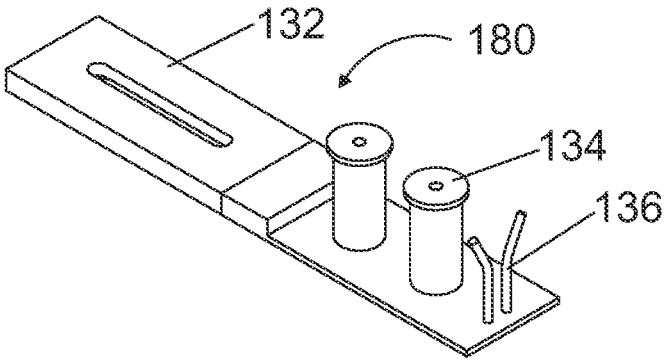
FIG. 20: A schematic perspective view of an embodiment of a vertical yarn holding device.
Figure 21:
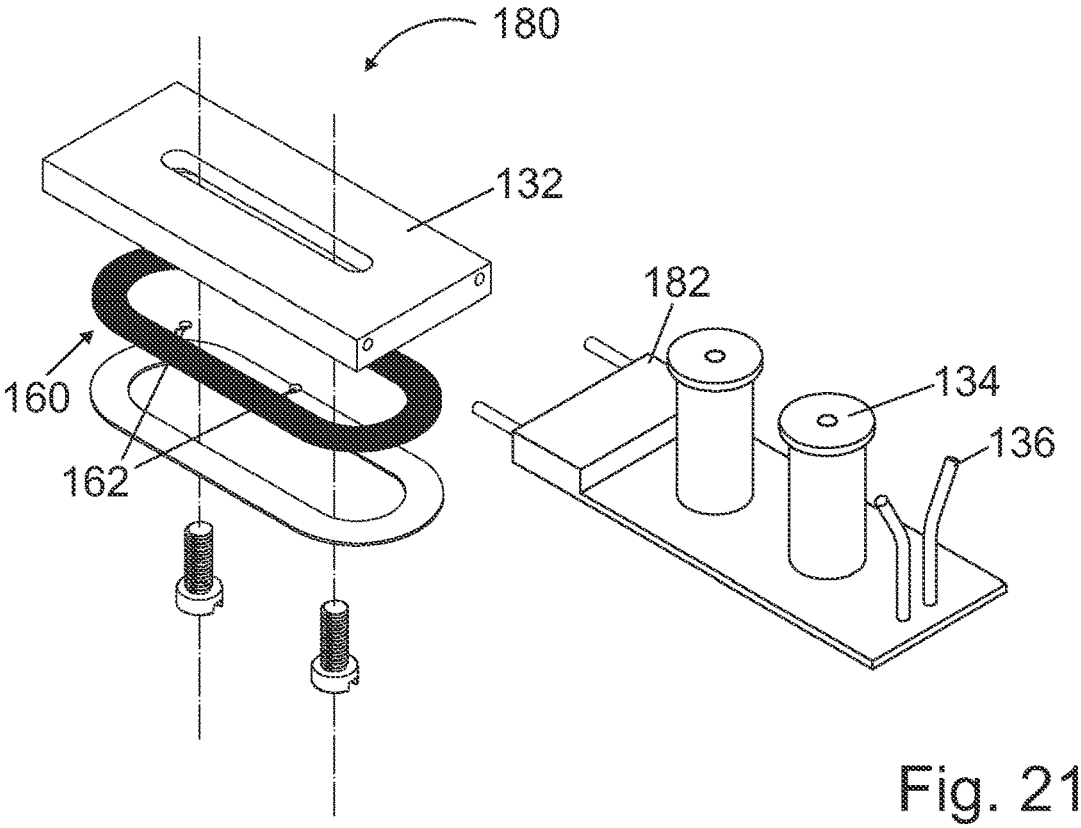
FIG. 21: A schematic perspective exploded view of an embodiment of a vertical yarn holding device.

FIG. 20 shows a schematic perspective view, and FIG. 21 shows an exploded view of an embodiment of a vertical yarn holding device 180. Like the horizontal yarn holding device 130, this comprises a base body 132, which has the same structure and connection options in a preferred modular embodiment. At the position where only the yarn gate 136 or the yarn guide 138 are fitted in the case of the horizontal yarn holding device 130, a separate module is fitted in the case of the vertical yarn holding device 180, which has the yarn holding rollers 134, which are aligned vertically with their axis of rotation, and the yarn gate 136 on a vertical base 182.

With the vertical yarn holding device 180, it is possible to form the yarn loop 4 formed over the yarn holding rollers 134 in a different, essentially horizontal orientation compared to the horizontal yarn holding device. Furthermore, a holding magnet 160 with contacts 162 is provided for screwing to the underside of the base body 132.

FIG. 21 illustrates the modular nature of the vertical yarn holding device 180, as the elements are interchangeable.

Figure 22:
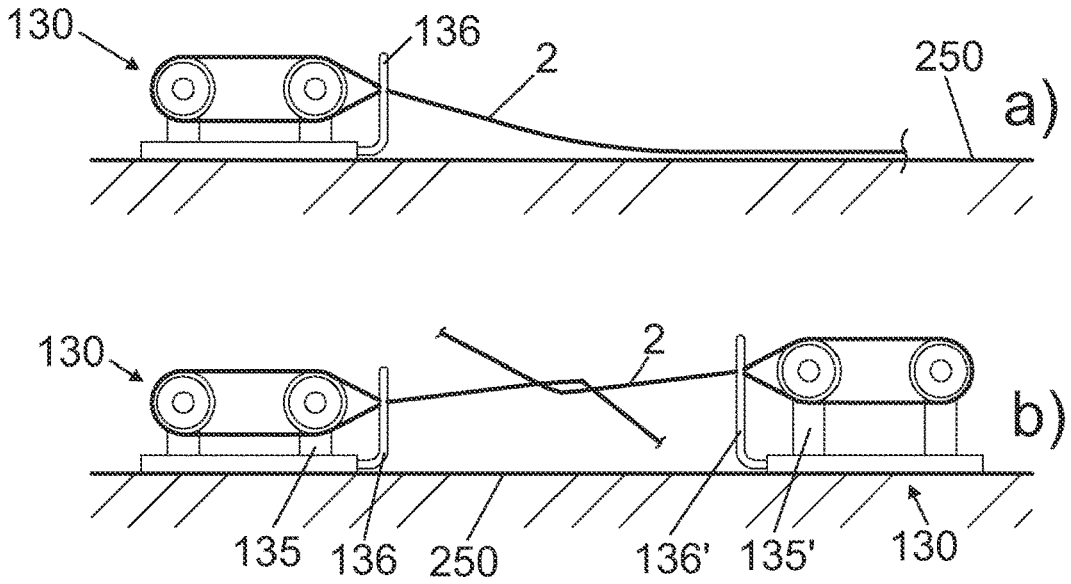
FIG. 22: A schematic side view of two embodiments of a horizontal yarn holding device with yarn gate and inserted yarn loop.

FIG. 22 shows a schematic side view of two embodiments of a horizontal yarn holding device 130 with yarn gate 136 and inserted yarn loop 4, whereby particular attention is paid to fixing the yarn 2. In view a), fixing on the shaping layer 250 is effected by pressing on the impregnated yarn or utilizing a preferably self-adhesive cover film 20 applied over it (also compare the yarn deposit device 300 as described for FIGS. 29 and 30).

View b) has two different horizontal yarn holding devices 130, which differ in their working height, whereby reference is also made to the explanation for FIG. 17. In any case, according to this embodiment, it is intended to bond the yarns 2 to one another without the latter having to rest on the shaping layer 250. The bonding is carried out analogously to view a) by bonding with the aid of impregnation or with an additional auxiliary.

Figure 23:
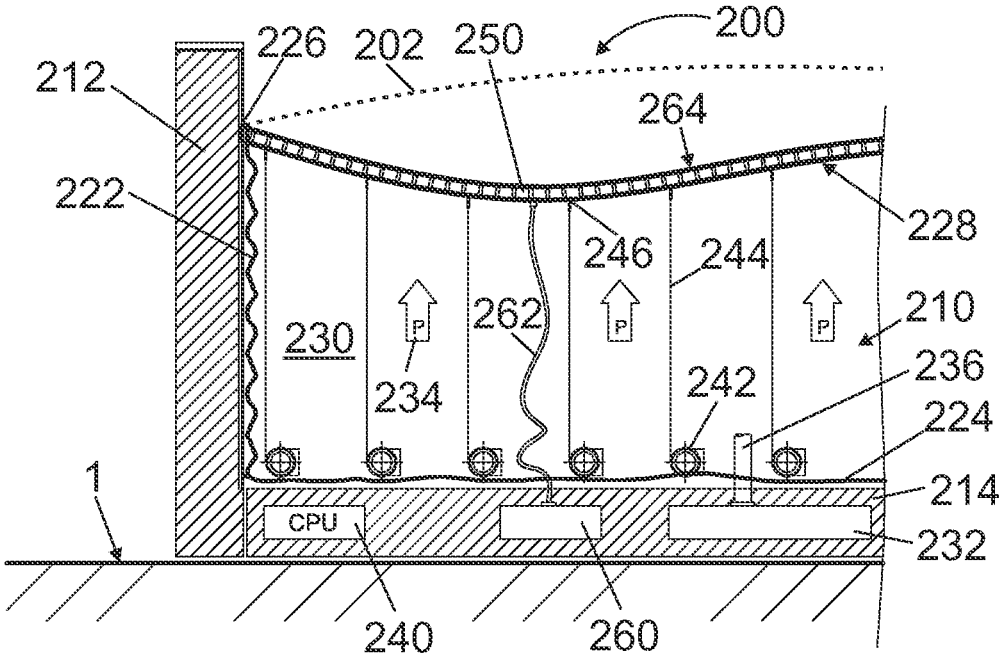
FIG. 23: A schematic cut-away side view of an embodiment of a shaping device according to the invention.

FIG. 23 shows a schematic cut-away side view of an embodiment of a shaping device 200 according to the invention, as preferably provided for forming the required curvature or free form. As is known, for example, from FIG. 1, the shaping device 200 is set up on base 1 and comprises, in addition to the side walls 212, floor 214. In order to obtain a closed space for a pressure vessel 210 in which a fluid 230 can be filled and a fluid pressure 234 can be achieved, the top side must also be covered. This is done utilizing the shaping layer 250.

Figure 25:
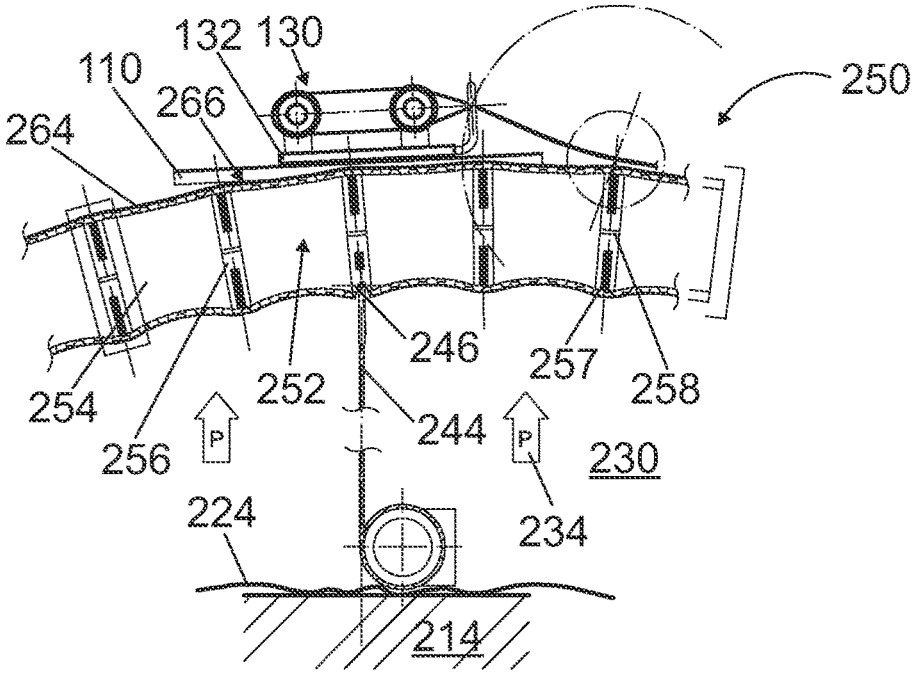
FIG. 25: A schematic cut-away side view of a detail of an embodiment of a shaping device according to the invention.

For more details on the structure of the shaping layer 250, please refer to FIG. 25 and the associated description. The shaping layer 250 has an inner sealing layer 228 on its underside facing the pressure vessel 210. In addition, a side membrane 222 is provided towards the side wall 212 for improved sealing, and a horizontal membrane 224 is provided towards the floor 214. The connection between the shaping layer 250 and the side wall 212 is provided by a sliding device 226, allowing unrestricted vertical movement of the edge region of the shaping layer 250 relative to the side wall 212.

A fluid pump 232 is provided to introduce fluid 230 into the pressure vessel 210 and to control the fluid pressure 234 of the fluid 230. This delivers fluid 230 via fluid inlet 236 into pressure vessel 210, which builds up the required internal pressure.

After the fluid pressure 234 is built up, the shaping layer 250 has a uniform camber 202. In order to achieve the ultimate desired topography of the surface of the shaping layer 250, it is pulled in the direction of floor 214 at several points against the fluid pressure 234. For this purpose, control cables 244 are provided on the shaping layer 250 at articulation points 246, which can be pulled by control motors 242. The control motors 242 are controlled utilizing a control device 240, which determines which of the control motors 242 must retract the corresponding control cable 244 by which length to achieve the desired height of the shaping layer 250 at the relevant position.

The side of the shaping layer 250 facing away from pressure vessel 210 has a forming plane formed as an outer sealing layer 264. This prevents contamination of the interior of the shaping layer 250 and already ensures a substantially flat surface, irrespective of the internal structure of the shaping layer 250. In order that the outer sealing layer 264 does not sink in, locally, at the points where it rests on a core layer 252 (compare FIG. 25 and the description there) of the shaping layer 250, it is provided that fluid pressure is built up between the inner sealing layer 228 and the outer sealing layer 264. For this purpose, a pump 260 is used to deliver a further fluid through pressure vessel 210 via a supply line 262 to the shaping layer 250.

Figure 24:
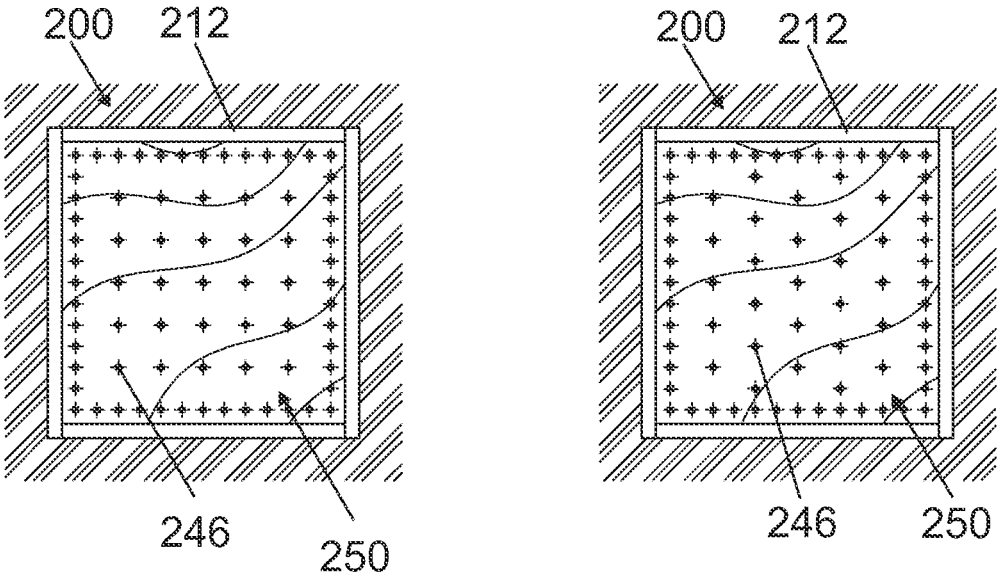
FIG. 24: A schematic top view of two embodiments of a shaping device according to the invention.

According to the invention, FIG. 24 shows a schematic top view of two embodiments of a shaping device 200, wherein the distribution of the articulation points 246 under the shaping layer 250 can be seen. The distribution of the articulation points 246 can be selected differently depending on the requirements. In addition, articulation points 246 are also distributed in the edge region to control the position of the shaping layer 250 in the edge region, near the side walls 212.

FIG. 25 shows a schematic cut-away side view of a detail of an embodiment of a shaping device 250 according to the invention, wherein also the floor 214, the horizontal membrane 224, and the control motor 242 are visible inside the pressure vessel 210. The control cable 244 pulled by the control motor 242 is connected to the shaping layer 250, particularly to the core layer 252 inside the shaping layer 250, at the articulation point 246.

The core layer 252 consists of individual, interconnected core elements 254. To prevent fluid 230 from the pressure vessel 210 from entering the core layer 252, the side of the core layer 252 facing the pressure vessel 210 is sealed using the inner sealing layer 228. The core elements 254 are connected to one another fluidly via overflow openings 258 and mechanically via connectors 256. They are furthermore provided with an iron insert 257.

The upper side of the shaping layer 250, on the other hand, is provided with the outer sealing layer 264, the function of which has already been mentioned in the explanations for FIG. 23. In addition, the horizontal yarn holding device 130 is placed on the outer sealing layer using frame strip 110, with an additional compensating layer 266 being arranged between the frame strip 110 and the outer sealing layer 264. The compensating layer 266 enables compensation between the curvature of the outer sealing layer 264 and the flat base surface of the base body 132. Instead of a compensating layer 266, the frame strip 110 alone, equipped with corresponding properties for height compensation, can also be used.

Figure 26:
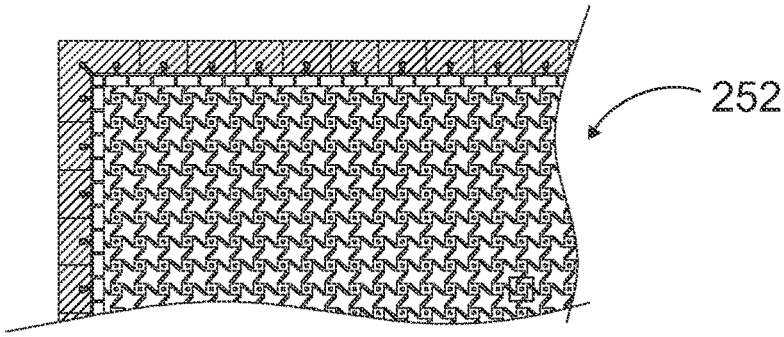
FIG. 26: A schematic top view of an embodiment of a shaping layer.
Figure 27:
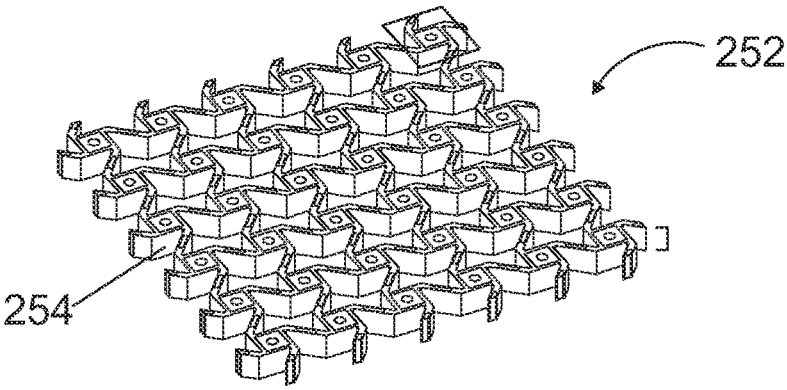
FIG. 27: A schematic perspective detail view of an embodiment of a shaping layer.

FIGS. 26 and 27 each show a section of an embodiment of core layer 252, with FIG. 26 a schematic plan view and FIG. 27 a schematic perspective detail view. The unique structure allows easy stretching and compression during shaping without permanent deformation and forming a homogeneous surface without undesirable deformation or protruding areas.

Figure 28:
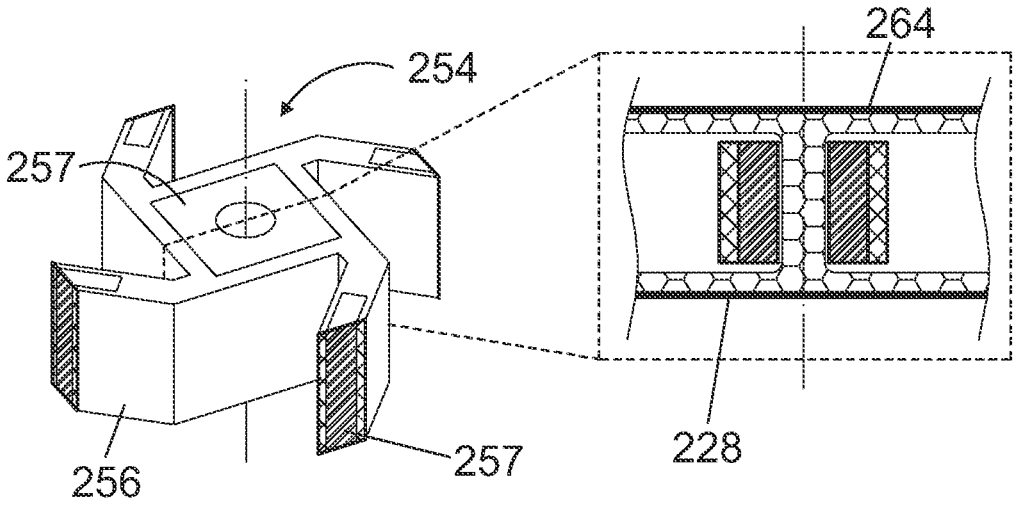
FIG. 28: A schematic view of an embodiment of a core element.

FIG. 28 shows a schematic view of an embodiment of a core element 254 with inner sealing layer 228 and outer sealing layer 264. The iron inserts 257 inside and in the connectors 256 allows interaction with a magnet.

FIG. 29 shows a schematic illustration of an embodiment of a yarn deposit device 300 with yarn pressing roller 314 and cover film applicator device 320, both in use according to the illustration. Yarn 2 is unwound from a reel and passes through a yarn impregnation device 310, where an impregnating agent 8 is applied to the yarn 2. The yarn 2 impregnated in such a manner is passed through a yarn guiding device 312 and applied to the shaping layer 250. In this process, pressing is carried out immediately after application using the yarn pressing roller 314.

This is immediately followed by applying a cover film 20, which is also conveyed from a roll, a cover film dispenser 322, and pressed onto the yarn 2 and against the shaping layer 250 utilizing a cover film pressing roller 324. This covers and secures yarn 2 (compare FIG. 31 and associated description). The yarn 2 is secured against lateral displacement and against lifting off from the shaping layer 250, particularly in concave regions.

FIG. 30 shows a schematic illustration of an embodiment of a yarn deposit device 300 similar to that shown in FIG. 29, but without the yarn pressing roller 314 and the cover film pressing roller 324 in use.

Figure 31:
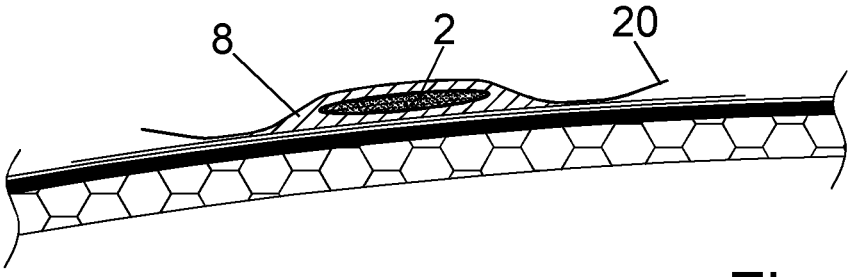
FIG. 31: A schematic sectional view of yarn with applied cover film.

FIG. 31 shows a schematic sectional view of yarn 2 with the applied cover film 20, which was previously provided with impregnating agent 8 and pressed on.

Figure 32:
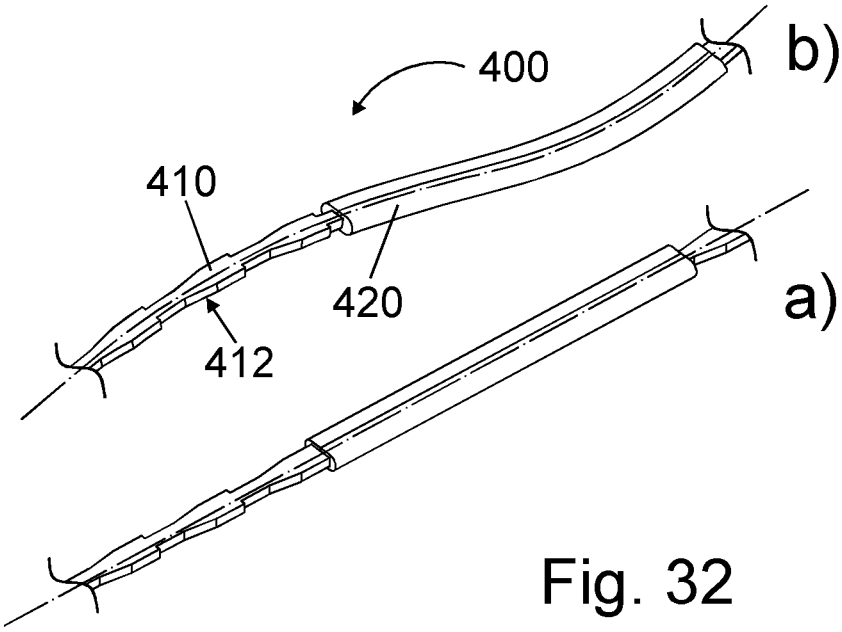
FIG. 32: A schematic perspective view of an embodiment of an edge connection is stretched and curved configuration.

FIG. 32 shows a schematic perspective view of an embodiment of a system for connecting textile-reinforced structural modules, an edge connection 400, once in stretched and once in a curved design. The edge connection 400 applies to flat, planar (view a) and curved, non-planar concrete structural modules 72 (view b). The edge connection 400 includes a flat wedge element 410 and two flat shells 420 that can slide longitudinally relative to each other, wherein wedges 412 engage the keyway 422 of the shell elements, the flat shells 420. The precise mode of operation is shown in the following figures and explained accordingly.

Figure 50:
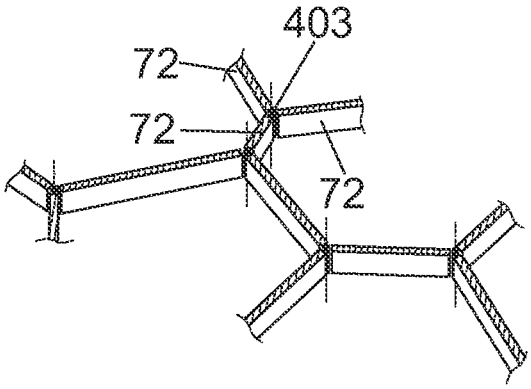
FIG. 50: A schematic perspective view of one use of an embodiment of an edge connection for connecting more than two concrete structural modules.
Figure 51:
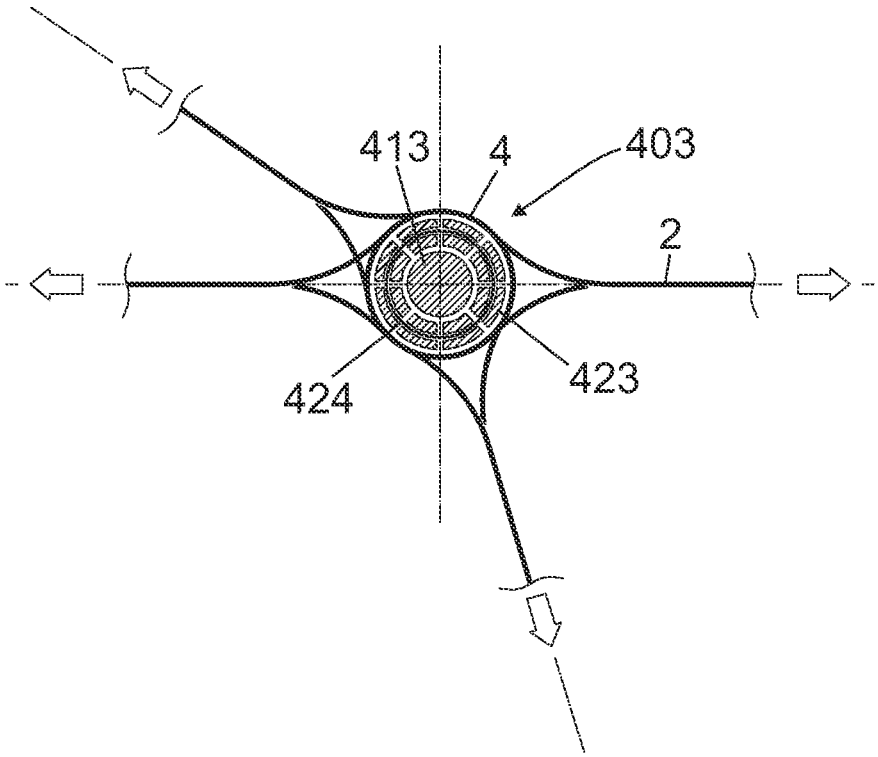
FIG. 51: Schematic sectional view of an embodiment of an edge connection for connecting more than two concrete structural modules.

The edge connection 400 can be used as unidirectional edge connection 400, as shown in FIG. 32, or multidirectional edge connection 403, cf. FIGS. 50 and 51. In unidirectional edge connection 400, the reinforcement from both connected concrete component and edge connection 400 forms a line or tangent at the location of the connection in the case of non-planar components. It also means that the unidirectional edge connection 400 is only suitable for connecting two structural modules, especially concrete structural modules. In turn, the unidirectional edge connection 400 includes two possible applications: the in-plane connection and the out-of-plane connection.

Figure 45:
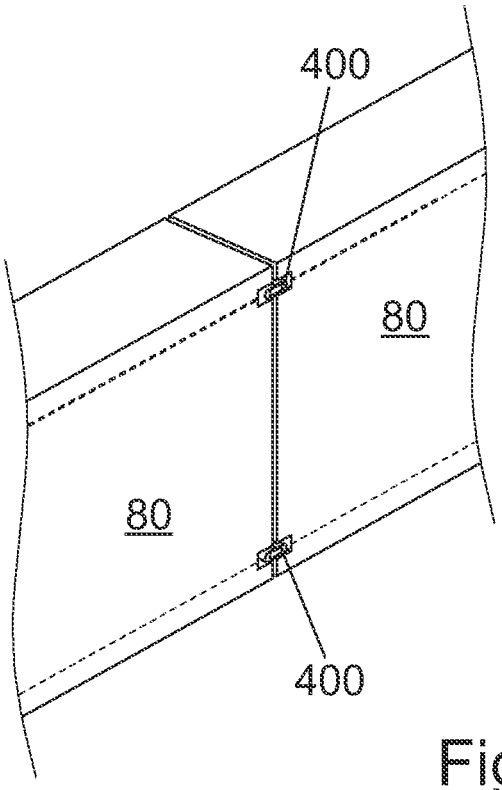
FIG. 45: A schematic perspective view of further use of an embodiment of an edge connection.
Figure 46:
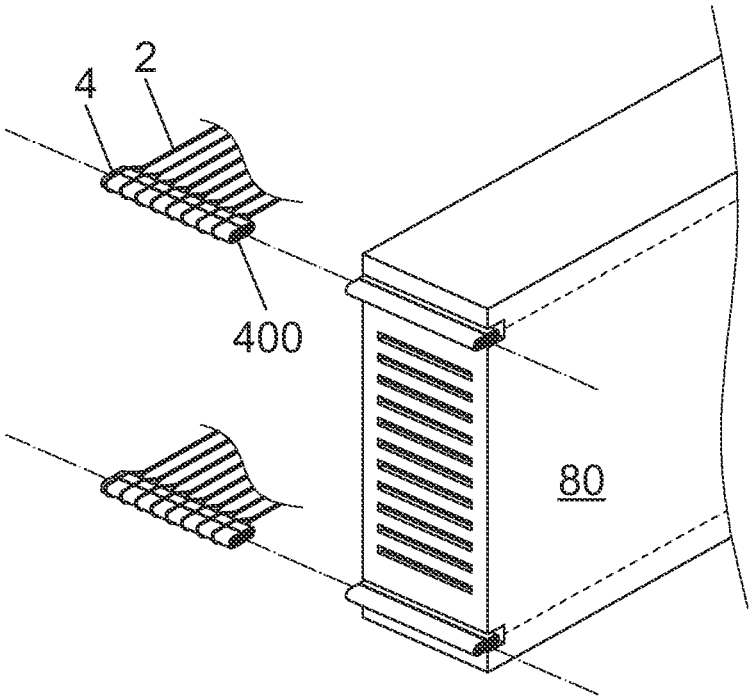
FIG. 46: A schematic perspective detail view of one use of an embodiment of an edge connection.
Figure 47:
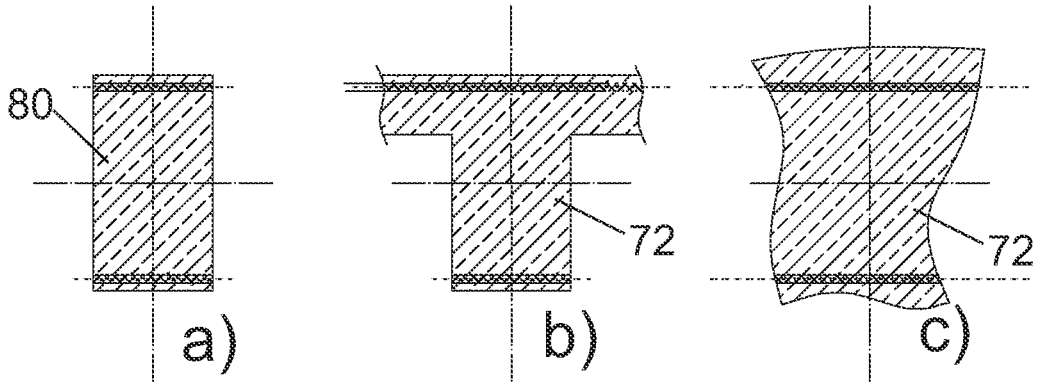
FIG. 47: A schematic cut-away view of three embodiments of an edge connection.

The in-plane connection includes solutions in which the edge connection 400 runs in the plane of concrete slabs or parallel to the concrete slabs, regardless of their topography. The horizontal course, in-plane connection, is predominantly used for shell and slab structures horizontally developed structures (cf. FIGS. 44*a, b*, and *c*). Beam elements, as shown in FIGS. 45-47 are also part of the in-plane solution, like sandwich solutions (cf. FIG. 44*b*).

To extend the functionality, there are the out-of-plane solutions, in which the edge connection 400 is arranged perpendicular to the plane of the concrete structures. In the case of the non-horizontal edge connection 400, the out-of-plane connection, concrete structures must be in the form of a grid or a cellular structure (cf. FIGS. 48-50).

The height and width of the wall elements or structural modules 72 with vertically oriented edge connection 400 or central connection 403 (cf. FIGS. 50 and 51) can differ. Thus, the non-horizontal edge connection 400 or central connection 403 can be used to connect solid walls in a building or relatively minor components of a complicated grid structure as structural modules 72, as shown in FIG. 50.

Figure 33:
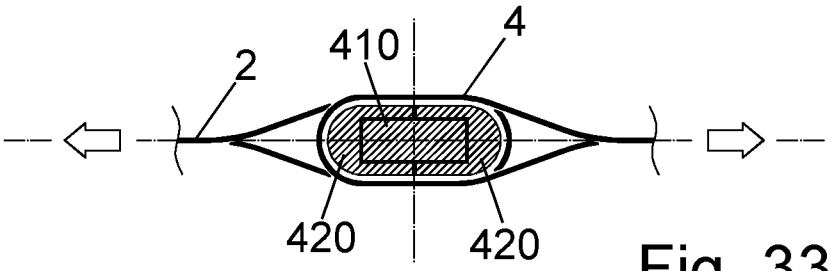
FIG. 33: A schematic sectional view of an embodiment of an edge connection with applied yarn loops.

FIG. 33 shows a schematic sectional view of an embodiment of an edge connection 400 with applied yarn loops 4, which originate from two concrete structural modules to be connected and overlap and interlock in the connection area. The edge connection 400 is inserted into the yarn loops 4 overlapping in this manner. As soon as the two flat shells 420 move away from each other as a result of the wedge effect when the flat wedge element 410 is driven in, the two yarn loops 4 are also pulled against each other (compare indicated direction of the arrow) and, as a result of the interlocking, the concrete structural modules not specified in more detail here are pulled together.

Figure 34:
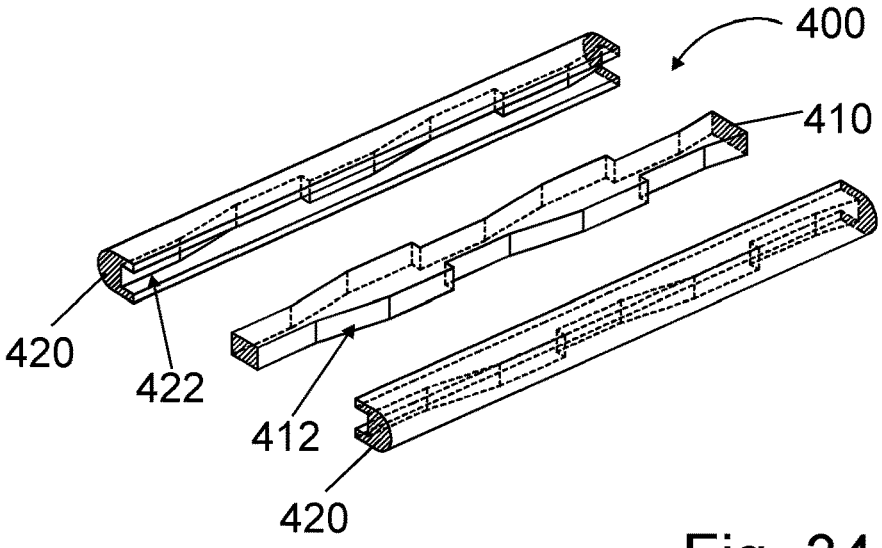
FIG. 34: A schematic perspective view of an embodiment of an edge connection comprising a flat wedge element and two flat shells.

FIG. 34 shows a schematic perspective view of an embodiment of an edge connection 400 comprising a flat wedge element 410, shown in the center, having wedges 412, and two flat shells 420 shown disposed laterally of the flat wedge element 410. The flat shells 420 each include a keyway 422 into which the flat wedge element 410 is insertable prior to assembly. The base of the keyway 422 also has wedge-shaped elements which, in cooperation with the wedges 412, cause an expanding movement perpendicular to the longitudinal extension of the flat wedge element 410 and the flat shells 420 during relative longitudinal movement between the flat wedge element 410 and the flat shells 420, when the flat wedge element 410 is driven between the flat shells 420, but preferably when it is pulled out of the flat shells 420. Sufficient tensile force acting on the flat wedge element 410 is required for extraction.

Figure 35:
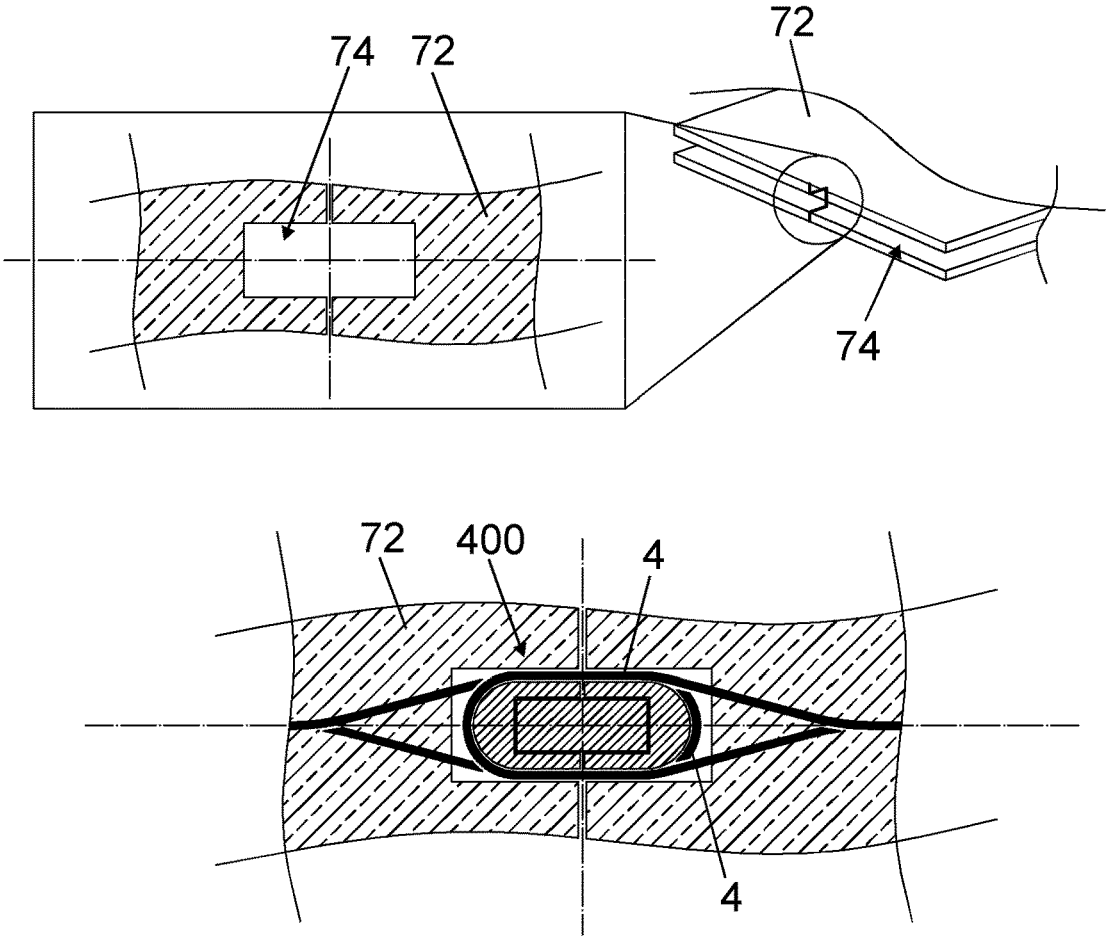
FIG. 35: A schematic view of a concrete structural module with an edge groove as well as an edge connection with applied yarn loops inserted into an edge groove.

FIG. 35 shows three schematic views, in perspective and in section, of a concrete structural module 72 with edge groove 74 and an edge connection 400 with applied yarn loops 4, inserted in the edge grooves 74 of the two concrete structural modules 72. The edge grooves 74 make it possible to make the connection, and the edge connection 400 inserted there invisible.

Figure 36:
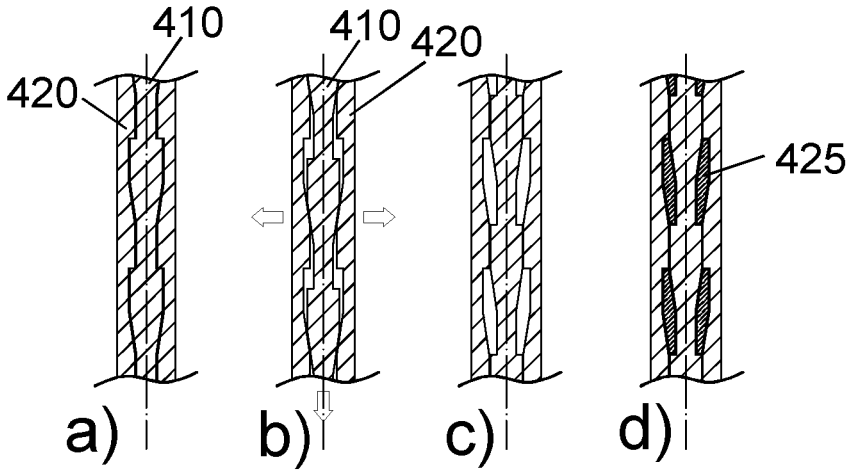
FIG. 36: A schematic view of an embodiment of an edge connection and the sequence of the spreading process.

FIG. 36 shows a schematic view of an embodiment of an edge connection 400 and the sequence of the spreading process. In view a), the flat wedge element 410 and the flat shells 420 are near each other. In view b), relative movement between the flat wedge element 410 and the flat shells 420 begins as the flat wedge element 410 is extended (compare downward direction of the arrow). As a result, spreading of the flat shells, 420 begins (compare the lateral direction of the arrow). In view c), the spreading is completed, while viewing d) indicates the optional insertion of a fixing agent 425, which prevents an undesired release of the wedging, for example, as a result of vibrations. Even if the flat wedge element 410 is not fully extended, the fixing agent 425 prevents the flat wedge element 410 from springing back.

Figure 37:
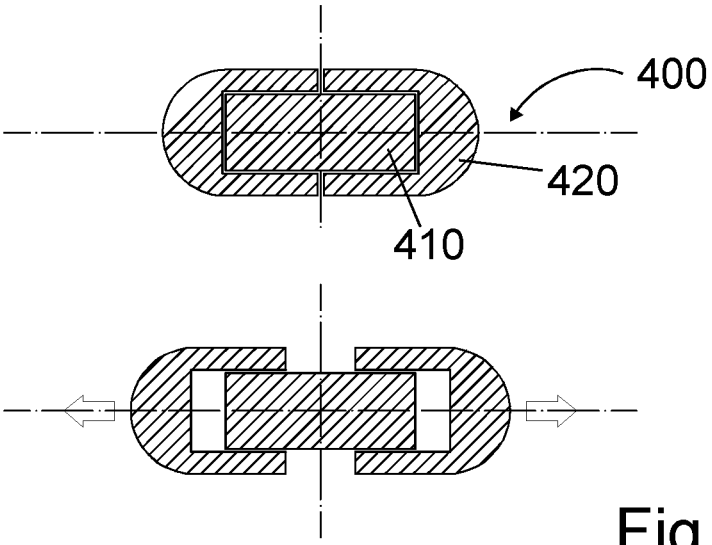
FIG. 37: A schematic sectional view of an embodiment of an edge connection, showing the sequence of the spreading process.
Figure 38:
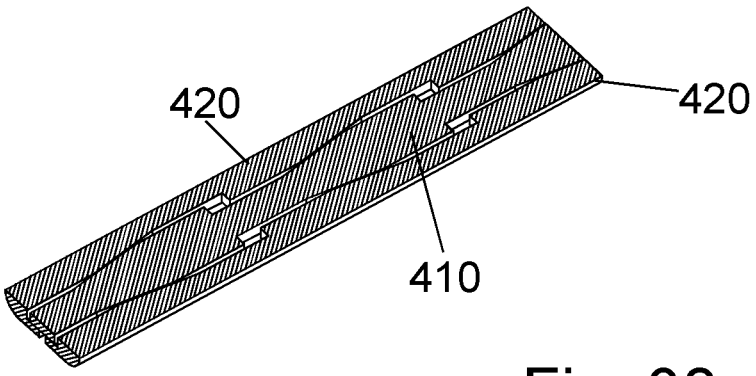
FIG. 38: A schematic perspective cut-away view of an edge connection showing the spreading process.

FIGS. 37 and 38 each show a schematic sectional view, once a cross-section and once a longitudinal section, of an embodiment of an edge connection 400, which shows the sequence of the spreading process as shown in FIG. 36 in a further enlarged form; reference is made in this respect to these explanations for FIG. 36

Figure 39:
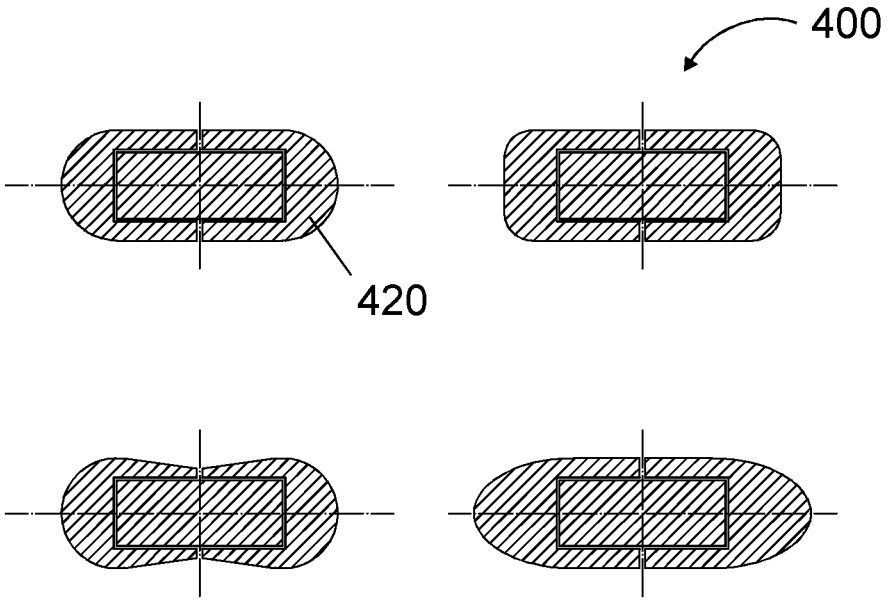
FIG. 39: A schematic cut-away view of four embodiments of an edge connector.
Figure 40:
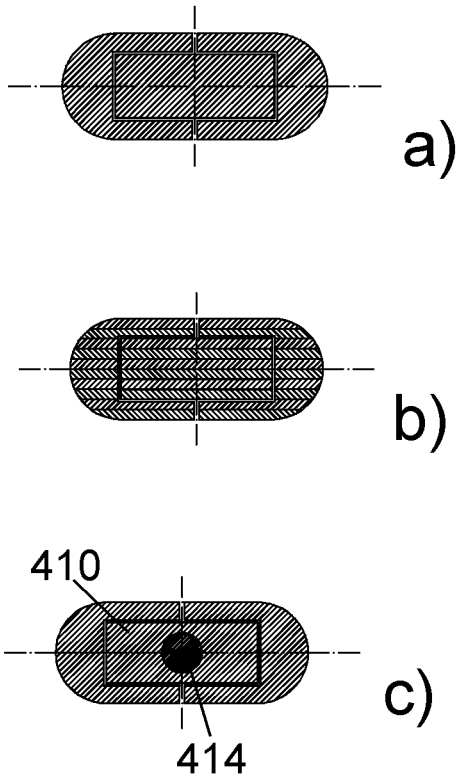
FIG. 40: A schematic cross-sectional view of three further embodiments of an edge connector.

FIG. 39 shows a schematic sectional view of an edge connection 400, wherein the flat shells 420 have different cross sections. An optimized adaptation to the cross-section of an edge groove 74 or the arrangement or formation of the yarn loops 4 can be achieved by selecting a suitable cross-section.

FIG. shows 40 a schematic sectional view of three further embodiments of an edge connection 400. According to view a), the embodiment represents a standard form in which all components consist of the same material. In the embodiment, according to view b), all components comprise a composite material or composite material that has been joined in layers on top of each other. According to view c), the embodiment has a dedicated wedge reinforcement 414 of the flat wedge element 410 for higher tensile strength and thus greater wedge forces.

Figure 41:
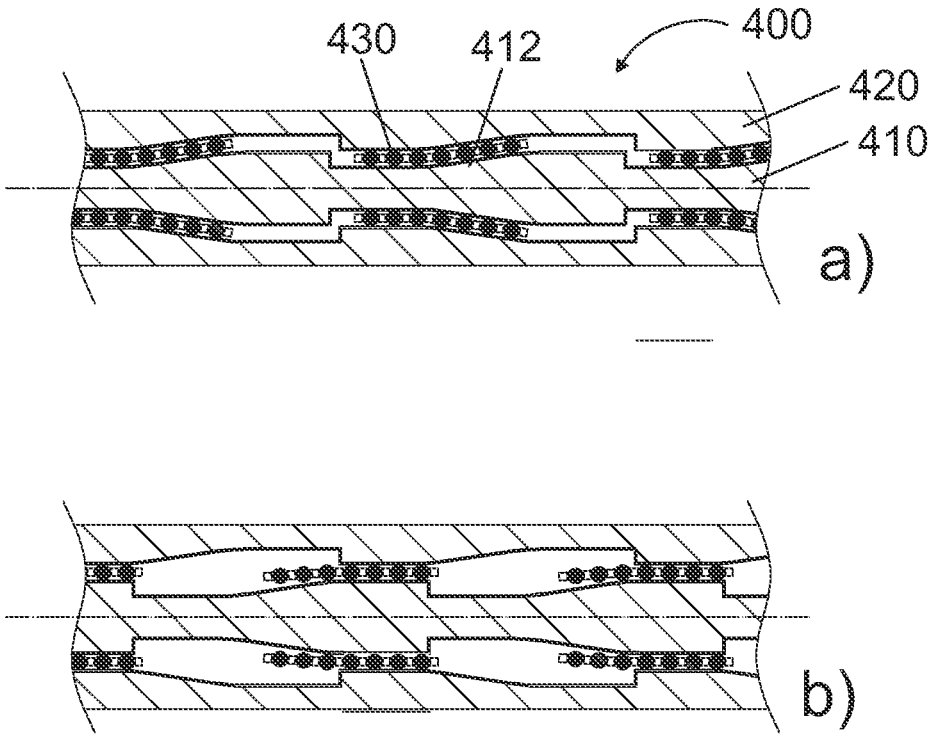
FIG. 41: A schematic sectional view of a further embodiment of an edge connection comprising a rolling track.

FIG. 41 shows a schematic cut-away view of another embodiment of an edge connection 400 comprising a rolling track 430 that facilitates the insertion or retraction of the flat wedge element 410 between the flat shells 420. Instead of sliding friction on the flanks of the wedges 412 with the corresponding contour of the keyway of the flat shell 420, rolling friction occurs using the rolling track 430. View a) shows the situation before the start of the spreading process, view b) at the end of the spreading process. An alternative embodiment of the rolling track 430 is not in sections, as shown, but is continuous.

Figure 42:
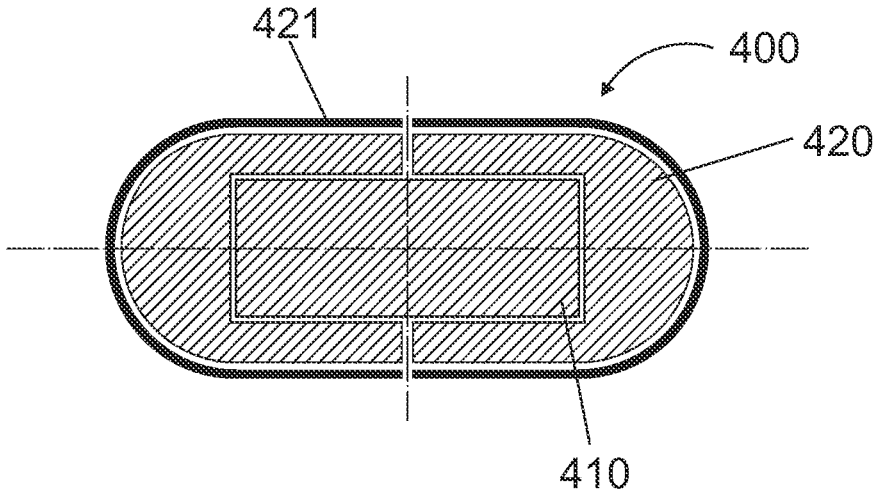
FIG. 42: A schematic sectional view of a further embodiment of an edge connection.

FIG. 42 shows a schematic sectional view of a further embodiment of an edge connection 400, which has flat shells 420 whose outer surface is provided with a retaining layer 421. This is easily deformable so that the yarn loops resting there sink into the retaining layer 421 under mechanical load. This secures the yarn loops against slipping in the longitudinal direction of the edge connection 400 so that when the flat wedge element 410 is pulled or pushed relative to the flat shells 420, no further counterforce needs to be applied. In addition, transverse forces acting on the flat shell 420 via the yarn loops are better distributed over the outer surface of the flat shells 420.

Figure 43:
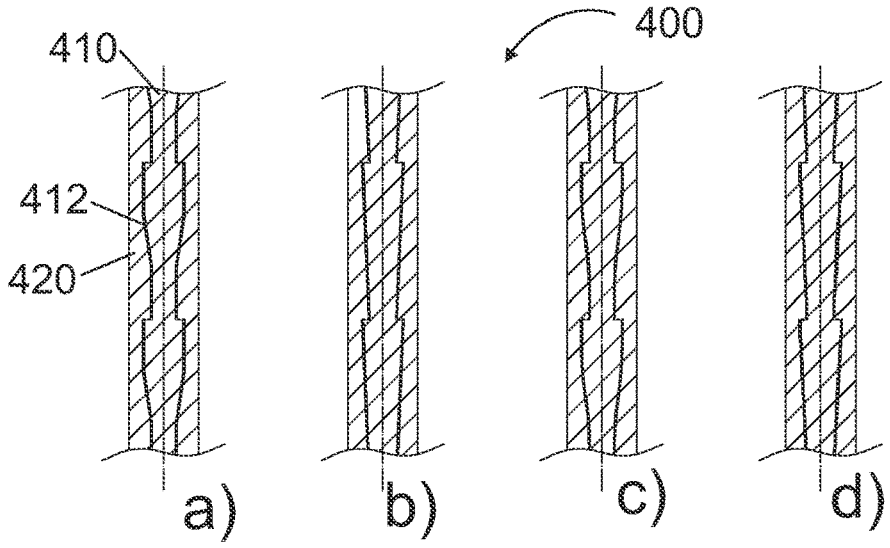
FIG. 43: A schematic view of three further embodiments of an edge connection in the longitudinal section.

FIG. 43 shows a schematic view of three further embodiments of an edge connection 400 in longitudinal section, with different shapes of wedges 412 being used in views a) to d). They differ in the force effect that can be applied in use, with the elongated wedges 412 of views b) and d) being suitable for achieving greater spreading force. In contrast, the wedges 412 of views a) and c) have flattened areas on which the interacting parts, flat wedge element 410 and flat shells 420, can rest after completion of the spreading operation without the need to apply further longitudinal forces. The long taper in the embodiment, according to view b) also allows for more precise control of the spreading force. In the embodiment, according to view c), the outer contour is formed as a spline so that only static friction has to be overcome at the beginning of the extraction process, and the spreading force starts later when the wedge 412 is already sliding motion. In the embodiment, according to view d), a staircase-like contour also enables the spreading force of the flat shells 420 to be set and applied in a stepwise, discrete, and thus concretely quantitative manner.

Figure 44:
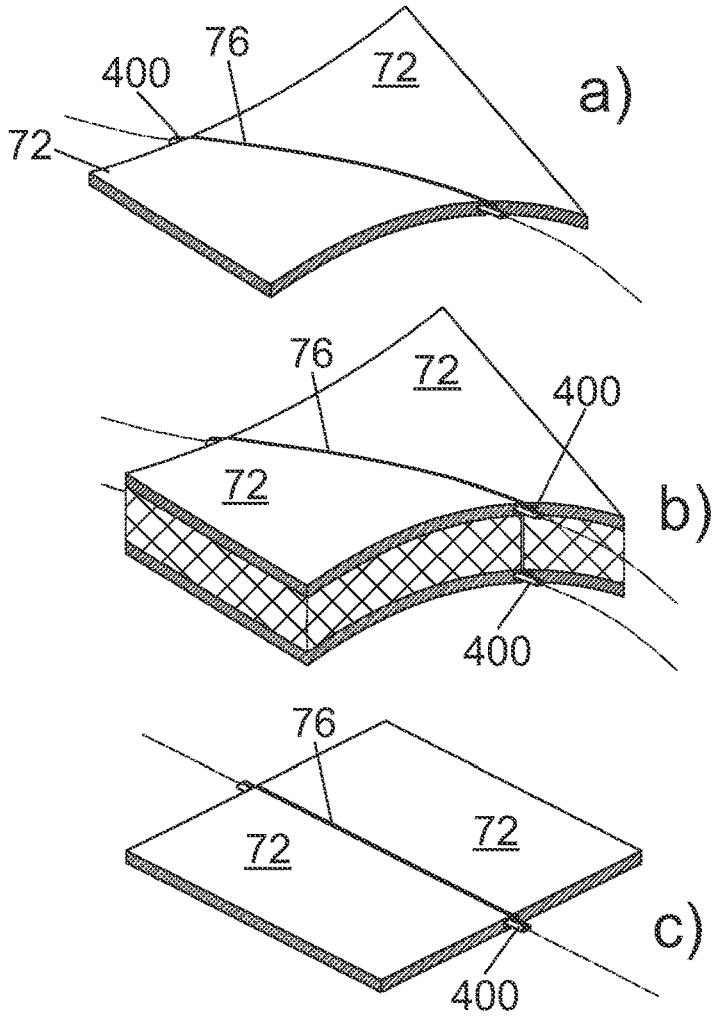
FIG. 44: A schematic perspective view of three uses of an embodiment of an edge connection.

FIG. 44 shows a schematic perspective view of three uses of an embodiment of an edge connection 400, wherein different embodiments of concrete structural modules 72 are connected. View a) shows two double-curved concrete structural modules 72 connected at a connecting edge 76 using edge connection 400.

View b) shows two concrete structural modules 72 in sandwich construction, where both shells of the sandwich construction have their edge connection 400. Similarly, the edge connection 400 is suitable for connecting flat concrete structural modules 72, as shown in view c).

FIG. 45 shows a schematic perspective view of further use of an embodiment of an edge connection 400, the use being for connecting two beams 80. An edge connection 400 is provided at the bottom on the tension side and the top on the compression side, assuming an axial load.

FIG. 46 shows a schematic perspective detail view of the use of an embodiment of an edge connection 400 according to FIG. 45, in which the edge connection 400 is additionally shown with the yarns 2 forming yarn loops 4. The edge connection 400 runs through the interlocking yarn loops 4. The yarn loops 4 of the second beam 80 to be connected, which also access the same edge connection 400, are to be added simultaneously since the situation is shown would no longer allow the yarn loops 4 of the other beam 80 to interlock. The yarn loops 4 of the elements to be connected must be engaged before the edge connection 400 can be inserted.

FIG. 47 shows a schematic sectional view of three further embodiments of an edge connection 400, wherein views a) to c) different elements are connected. View a) corresponds to the use shown in FIGS. 45 and 46, while views b) with a T-beam and c) with a free-form element show other embodiments of concrete structural modules 72.

Figure 48:
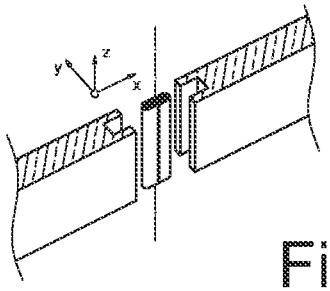
FIG. 48: A schematic perspective view of one use of an embodiment of an edge connection.
Figure 49:
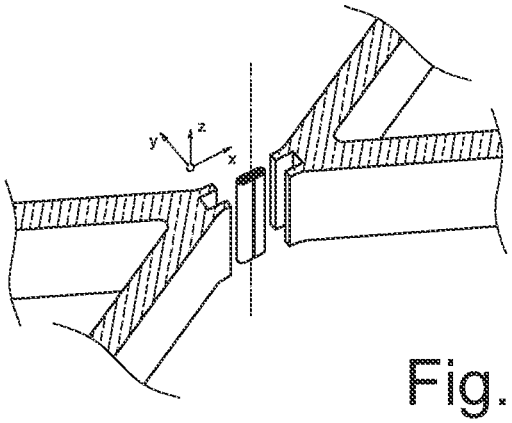
FIG. 49: A schematic perspective view of another use of an embodiment of an edge connection.

FIGS. 48 and 49 each show a schematic perspective view of further use of an embodiment of an edge connection 400. FIG. 48 shows an embodiment of an edge connection 400 that is also suitable for connecting beams or various load-bearing or non-load-bearing wall elements. In this case, the connection is made using vertical connections, as shown in FIG. 48. This allows, for example, different grids or grid structures of concrete components or concrete elements to be connected, as shown in FIGS. 49 and 50.

The previously described unidirectional edge connection 400 connects two concrete structural modules 72 (see, e.g., FIG. 44). It is not suitable for connecting more than two concrete elements to create a cellular structure.

Therefore, to extend the functionality of the edge connection 400, as shown in FIGS. 44 to 49, a modification is envisioned to provide a multidirectional edge connection shown in FIGS. 50 and 51. This is achieved by a central connection 403, as shown in detail in FIG. 51. This is suitable for forming mesh structures with variable angles and connecting edges, as shown in FIG. 50. With a schematic perspective view of using an embodiment of a central connection 403 for connecting more than two concrete structural modules 72.

In this case, several webs of adjacent concrete structural modules 72 cross at a common multidirectional edge connection, the central connection 403. The yarn loops 4 (cf., e.g., FIG. 51, 53, or 57), which cannot be seen, are produced as previously explained (cf. FIGS. 7-22). The cylindrical structure of the multidirectional central connection 403 allows for radial expansion instead of lateral expansion for a unidirectional edge connection 400, and therefore, it is possible to provide expansion in any direction of the plane intersecting the multidirectional central connection 403.

The central connection 403 has the same key components as the unidirectional edge connection 400. The multidirectional central connection 403 also comprises a central part, designed as a cylindrical wedge element 413, and several side parts designed as cylindrical shells 423. In this regard, the wedge element is also provided with a circular cross-section and is configured as a cylindrical wedge element 413, just as the shell elements are configured as a section of a circular ring, as a cylindrical shell 423. The cylindrical wedge element 413 can have different contours on its surface according to the illustration in FIG. 43 and thus different functionalities.

The multidirectional central connection 403 is similar in function to the edge connection 400, which is also designed to extend transversely through the textile yarn loops 4 (cf., inter alia, FIG. 46) and cause bracing between the concrete structural modules 72 or the beams 80. The various yarn loops 4, each formed from one yarn 2, are no longer oval but circular in shape. This is due to the central connection 403 having a circular cross-section.

However, an essential difference between the central connection 403 and the edge connection 400 is the introduction of a resilient circular ring holder 424. In the case of a multidirectional central connection 403, the resilient circular ring holder 424 holds the associated components together before the central connection 403 is introduced into the joint channel formed by the interlocking yarn loops 4. The circular ring holder 424 can theoretically also be used for the unidirectional edge connector to hold its components together prior to insertion into the edge grooves.

Figure 52:
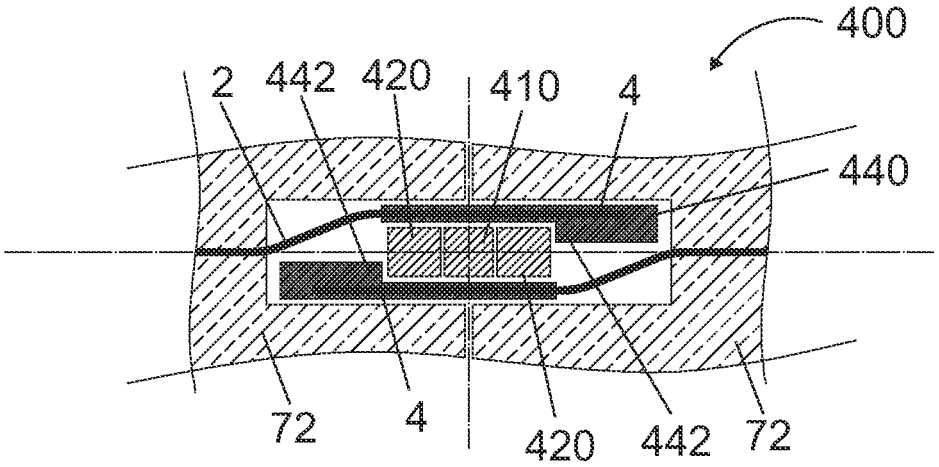
FIG. 52: A Schematic sectional view of a further embodiment of an edge connection without overlapping interlocking yarn loops.

FIG. 52 shows a schematic sectional view of a further embodiment of an edge connection 400, which, in a particularly advantageous manner, does not require interlocking overlapping of the yarn loops 4 prior to assembly. This facilitates assembly since, in this embodiment, the relatively unstable yarn loops 4 do not first have to be brought to overlap to create an opening for insertion.

Figure 53:
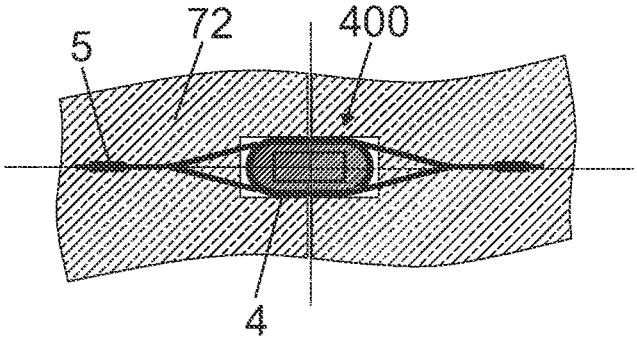
FIG. 53: A schematic sectional view of a further embodiment of an edge connection with separately inserted yarn loops.

Instead, regarding the embodiment according to FIGS. 32, 35 and 53, the yarn loops 4 are rotated and inserted into a loop bed 440. This has a projection 442, in which the flat shell 420, which is formed in particular with a sharp edge and is secured against undesired slipping off the loop bed 440, engages in each case. If the flat shells 420 are spread due to the interaction between the flat wedge element 410 and the flat shell 420, the desired tensile force is exerted on yarn 2 via the loop bed 440 belonging to each yarn loop 4.

FIG. 53 shows a schematic sectional view of a further embodiment of an edge connection 400 with separate yarn loops 4, which are not tied to a textile reinforcement but are embedded in the curable material of the concrete structural module 72. An improved hold is provided by a loop holder 5, which at the same time binds the two ends of the yarn loop 4 together. The loop holder 5 is preferably designed as an anchor which can be anchored in the curable material.

Figure 54:
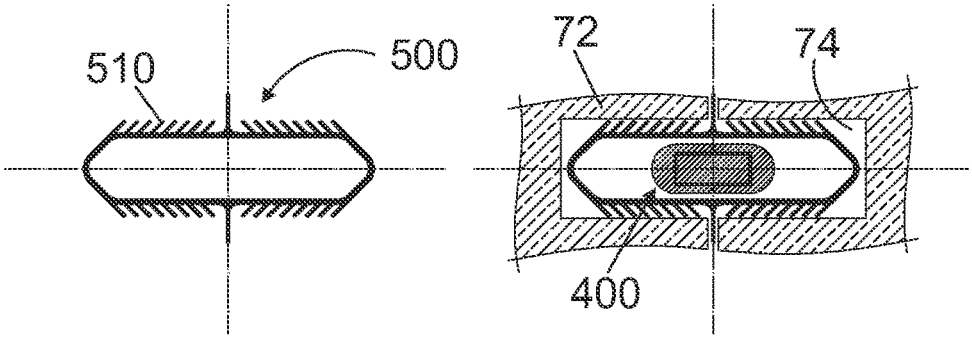
FIG. 54: A schematic sectional view of an embodiment of an assembly aid tool.
Figure 55:
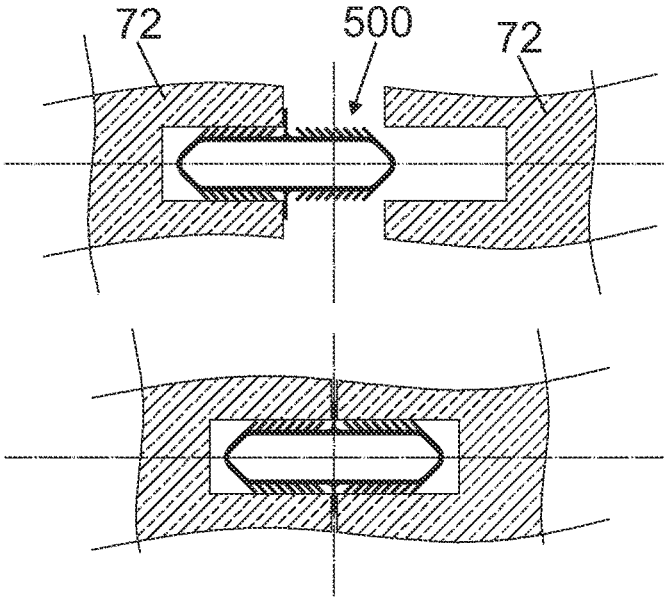
FIG. 55: A schematic sectional view of one use of the assembly aid tool.
Figure 56:
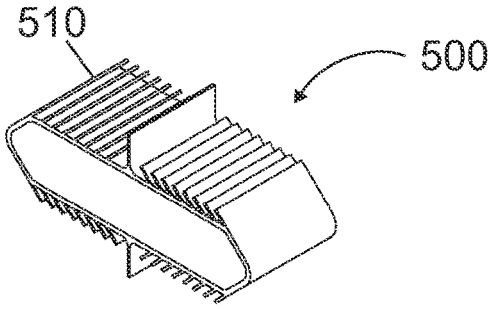
FIG. 56: A schematic perspective view of a further embodiment of an assembly aid tool, and According to the invention.

FIG. 54 shows a schematic sectional view of an embodiment of a mounting aid tool 500 inserted into the edge groove 74 of the first concrete structural module 72 to facilitate placement of the second concrete structural module 72. The assembly aid tool 500 includes a hook profile 510 that can compensate for surface inaccuracies in the edge groove and make it more difficult for the assembly aid tool 500 to slide back undesirably. The assembly and use are illustrated in FIG. 55. FIG. 54 also shows that the edge connection 400 can be used inside the mounting aid tool 500 without removing the mounting aid tool 500. The yarn loops are not shown. FIG. 56 shows another schematic perspective view of an embodiment of the mounting aid tool 500.

Figure 57:
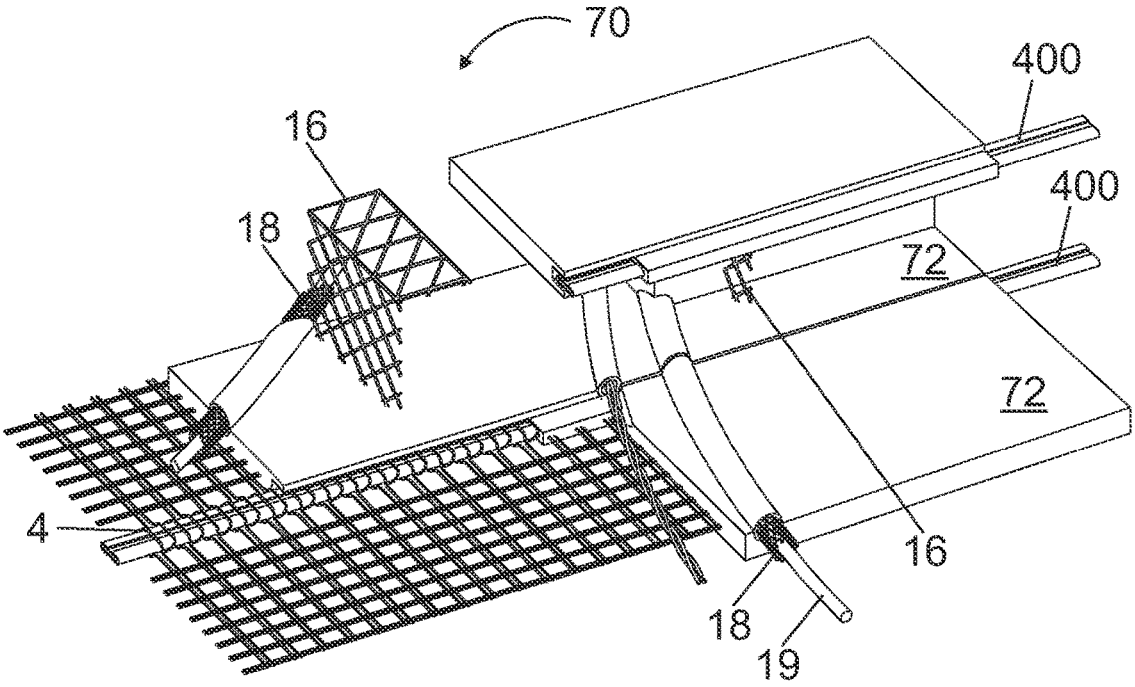
FIG. 57: a schematic perspective view of an embodiment of a concrete component.

FIG. 57 shows a schematic perspective view of an embodiment of a concrete structural element 70 according to the invention. In the embodiment shown, this is shown as a sandwich element, so that the concrete structural modules 72, which form the two shells of the sandwich element, are each connected with a separate edge connection 400. The area of reinforcement 10 shown without concrete cover illustrates the interlocking of the yarn loops 4, each belonging to the reinforcement 10 of both concrete structural modules 72.

Furthermore, a transverse reinforcement 16, a structural shape reinforcement made of a textile grid-like structure, is shown, which both engages the two shells of the sandwich element and represents the connection and spacing structure between the two shells.

Further, a grid tubular reinforcement 18 is provided to allow high forces to be Introduced in the intended direction and to dissipate those forces. The grid tubular reinforcement 18 can also dissipate forces across multiple concrete structural modules 72. For this purpose, a reinforcement strand 19 is inserted into the grid tubular reinforcement 18. A conduit may also be passed therethrough in place of the reinforcement strand 19.

LIST OF REFERENCE NUMERALS

1 Base
2 Yarn
4 Yarn loop
5 Loop holder
6 Orientation plane
8 Impregnating agent
10 Reinforcement
12 Concave region
14 Convex region
16 Transverse force reinforcement
20 Cover film
70 Concrete component
72 (Concrete) structural module
74 Edge groove
76 Connecting edge
80 Beam
100 Base frame
110 Frame strip
115 Monopod foot
120 Conductive path
122 Connection line
130 Yarn holding device, horizontal yarn holding device
132 Base body
134 Yarn holding roller
135, Support stand
135'
136, Yarn gate
136'
138 Yarn guide
140 Steering cylinder
160 Holding magnet
162 Contact
180 Yarn holding device, vertical yarn holding device
182 Vertical base
200 Shaping device
202 Camber
210 Pressure vessel
212 Side wall
214 Floor
222 Side membrane
224 Horizontal membrane
226 Sliding device
228 Inner sealing layer
230 Fluid
232 Fluid pump
234 Fluid pressure
236 Fluid inlet
240 Control device
242 Control motor
244 Actuator, control cable
246 Articulation point
250 Shaping layer
252 Core layer
254 Core element
256 Connector
257 Iron insert
258 Overflow opening
260 Pump
262 Supply line
264 Forming surface, outer sealing layer
266 Compensating layer

290 Forming block, wax block
300 Yarn deposit device
310 Yarn impregnation device
312 Yarn guiding device
314 Yarn pressing roller
320 Cover film applicator
322 Cover film dispenser
324 Cover film pressing roller
400 System for connecting, edge connection
403 System for connecting, central connection
410 Wedge element, flat wedge element
412 Wedge
413 Wedge element, cylindrical wedge element
414 Wedge reinforcement
420 Shell element, flat shell
421 Holding layer
422 Keyway
423 Shell element, cylindrical shell
424 Circle ring holder
425 Fixing agent
430 Rolling track
440 Loop bed
500 Mounting aid tool
510 Hook profile
D Diameter (steering cylinder)

The invention claimed is:

1. A system for connecting textile-reinforced structural modules (72) along at least one connecting edge (76), wherein each structural module (72) has at least one continuous edge groove (74) having yarn loops (4) along at least the connecting edge (76), wherein a system (400, 403) comprises a wedge element (410, 413), has wedges (412) on at least one outer surface thereof and at least one shell element (420, 423) has surfaces corresponding to the wedges (412), wherein the yarn loops (4) are wrapping the system (400, 403), wherein the wedge element (410, 413) and the at least one shell element (420, 423) are inserted into the at least two edge grooves (74) with the overlapping yarn loops (4) in a way that the wedges (412) and the corresponding surfaces face each other, wherein further the wedge element (410, 413) is provided for partial extension or insertion relative to the at least one shell element (420, 413), so that by means of wedge action between the wedges (412) and the corresponding surfaces the wedge element (410, 413) and the at least one shell element (420, 423) are spread apart from each other when the wedge element (410, 413) is partially pulled out, forcing a distal end of each yarn loop (4) outward away from the continuous edge groove, which moves the distal end of a yarn loop of a first module away from a distal end of a yarn loop of an adjacent module, wherein each yarn loop is captive around a shell element and wedge, they cannot move away from each other, the yarn loops (4) are drawn towards each other at the same time, characterized in that the yarn loops (4) are part of the textile reinforcement of the structural modules (72), the wedge element (410, 413) and the at least one shell element (420, 423) follow the course thereof continuously over the entire length of the connecting edge (76).

2. The system according to claim 1, which is embodied as an edge connection (400) and comprises the wedge element embodied as a flat wedge element (410) with wedges (412) arranged on the two flat sides, and further comprises two shell elements, each having a keyway (422) on the base of which the corresponding surfaces are arranged, embodied as flat shells (420).

3. The system according to claim 1, which is embodied as a central connection (403) and comprises the wedge element embodied as a cylindrical wedge element (413) with ring-shaped continuously arranged wedges (412) and further comprises the shell elements, which have the corresponding surfaces embodied as a cylindrical shell (423).

4. The system according to claim 1, wherein the yarn loops (4) are aligned to engage with each other to form an opening for insertion of the edge connection (400) or the central connection (403) into the engaged yarn loops (4), wherein the yarn loops (4) can be spread using the inserted shell elements (420, 423) in cooperation with the at least one wedge element (410, 413), or according to a second embodiment, the yarn loops (4) are aligned horizontally with respect to the longitudinal direction of the edge groove (74) and the yarn loops (4) of each of the connecting edges (76) are bound into a loop bed (440), wherein the loop beds (440) can be spread by form-fitting engaging flat shells (420) in cooperation with the flat wedge element (410).

5. The system of claim 1, wherein the contact surfaces between the shell element (420) and the wedge element (410) comprise rolling tracks (430).

6. The system of claim 1, wherein a mounting aid tool (500) is provided that engages at least a portion of the edge groove (74) of the structural modules (72) to be connected and within which the edge connection (400) can be guided so that the mounting aid tool (500) remains within the connected structural modules (72).

* * * * *